US005706775A

United States Patent [19]

Schweter et al.

[11] Patent Number: 5,706,775

[45] Date of Patent: Jan. 13, 1998

[54] ROTARY VALVE APPARATUS FOR INTERNAL COMBUSTION ENGINES AND METHODS OF OPERATING SAME

[75] Inventors: Timothy S. Schweter, Cleveland; Joseph F. Buehner, Wadsworth; David M. Lane, Parma Heights, all of Ohio

[73] Assignee: New Avenue Development Corp., Parma Heights, Ohio

[21] Appl. No.: 631,476

[22] Filed: Apr. 12, 1996

[51] Int. Cl.[6] ..... F01L 7/02

[52] U.S. Cl. ..... 123/190.12; 123/190.5; 123/190.6; 123/190.8

[58] Field of Search ..... 123/190.12, 190.4, 123/190.5, 190.6, 190.8

[56] References Cited

U.S. PATENT DOCUMENTS

| | | | |
|---|---|---|---|
| 2,401,932 | 6/1946 | Heintz . | |
| 3,628,518 | 12/1971 | Blair et al. . | |
| 4,016,840 | 4/1977 | Lockshaw . | |
| 4,019,488 | 4/1977 | Kremer . | |
| 4,098,514 | 7/1978 | Guenther . | |
| 4,481,917 | 11/1984 | Rus et al. | 123/190.12 |
| 4,494,500 | 1/1985 | Hansen . | |
| 4,517,938 | 5/1985 | Krüger | 123/190.6 |
| 4,751,900 | 6/1988 | Ruffolo | 123/190.6 |
| 4,879,979 | 11/1989 | Triguero | 123/190.6 |
| 5,074,265 | 12/1991 | Ristin et al. . | |
| 5,205,251 | 4/1993 | Conklin | 123/190.12 |
| 5,249,553 | 10/1993 | Guiod . | |
| 5,309,876 | 5/1994 | Schiattino | 123/190.2 |
| 5,315,963 | 5/1994 | Warf . | |
| 5,315,969 | 5/1994 | MacMillan . | |
| 5,361,739 | 11/1994 | Coates . | |
| 5,372,104 | 12/1994 | Griffin . | |
| 5,392,743 | 2/1995 | Dokonal | 123/190.4 |
| 5,448,971 | 9/1995 | Blundell et al. | 123/190.12 |
| 5,526,780 | 6/1996 | Wallis | 123/190.6 |
| 5,572,967 | 11/1996 | Donaldson, Jr. | 123/190.12 |

*Primary Examiner*—Erick R. Solis
*Attorney, Agent, or Firm*—Howard M. Cohn

[57] ABSTRACT

A rotary valve system mounted to an internal combustion engines and method of operating the system primarily comprises a rotary valve mounted within a valve sleeve, which is in turn mounted within a longitudinal bore extending through an intake and exhaust manifold. Controllers vary the rotational and axial position of the valve sleeve, which provides the capability of adjusting the amount of fuel mixture entering the combustion chambers of the engine and the timing of the intake of such mixture. The method of operation includes in taking fuel mixture into, and evacuating exhaust gas from, an internal combustion engine, wherein fuel mixture flows into the manifold, is directed across the valve sleeve, through the rotary valve, across the sleeve, and into a combustion chamber. After combustion of the fuel mixture, the exhaust gases are directed from the combustion chamber through the sleeve, through the rotary valve and into an exhaust chamber. Then the exhaust gases flow through the sleeve and into an associated manifold exhaust passage. An alternative embodiment of a rotary valve system primarily comprises a rotary valve body mounted within an intake and exhaust manifold, with the valve body and manifold constructed substantially identical to the first embodiment, but without a valve sleeve. This embodiment operates in a manner similar to the first embodiment, the ability to adjust the amount of fuel-air mixture or the timing of the intake of such mixture is limited.

10 Claims, 14 Drawing Sheets

VALVE OPENING

VALVE OPENING

MAXIMUM OPEN

MAXIMUM OPEN

VALVE CLOSING

VALVE CLOSING

ROTARY VALVE APPARATUS FOR INTERNAL COMBUSTION ENGINES AND METHODS OF OPERATING SAME

FIELD OF THE INVENTION

This invention relates to the field of internal combustion engines, and more particularly, to the use of a rotary valve arrangement for controlling the flow of gases into and out of the working volume of such engines.

BACKGROUND OF THE INVENTION

There are presently a number of different internal combustion engine designs which are well-known in the prior art. These engines incorporate a variety of unique designs for such components as camshafts, valves, pistons, lubrication systems, fuel systems, etc. One important engine component in piston and cylinder engines is the valve system for charging the cylinders with fuel-air mixture for the combustion cycle and evacuating the exhaust gases at the exhaust cycle of each cylinder of the engine. Valve systems come in two basic varieties; the traditional spring-loaded, cam-operated poppet valve systems and the more modem rotary valve systems.

Poppet valve systems involve a relatively large number of parts such as springs, cotters, guides, rocker shafts, cams, a camshaft and the valves themselves. Besides requiring numerous parts, one problem with these systems is that the timing of the opening and closing of the valves is very important, and becomes critical at higher engine speeds, in order to prevent the inadvertent contact of the piston with an open valve, which can cause serious engine damage. Conventional poppet valves create a substantial amount of resistance to gas flow as they are only opened around the annular edges thereof. Further, these conventional poppet valve engines require considerable power to open the valves against the force of the valve spring, the application of such power causing further wear in the valve train. And further yet, the fact that the components of the valve train are reciprocating causes power to be dissipated in overcoming the inertia of these components when changing their direction. In addition, the timing of the opening the intake and exhaust valves is inflexible once established by the design of the camshaft.

Turning to rotary valve systems, it is generally acknowledged that such systems are potentially more cost effective and easier to assemble due to their simplicity and lower weight. Rotary valve systems reduce the number of moving parts and thereby reduce the friction caused by their operation, which causes an increase in engine operating efficiency. They can be made with larger valve openings and are not limited by the restrictions imposed by camshaft configurations such as the necessary rise and fall times of the poppet valve operating cams. Further, they are simpler in that they eliminate the need for valve operating trains. Examples of rotary valve systems are shown in U.S. Pat. Nos. 4,481,917 and 5,074,265.

However, despite a number of desirable features of rotary valve systems, the use of rotary valves has been disfavored due to a number of problems. One problem from which prior art rotary valve designs suffer is inflexible timing, which is fixed by the design of the head ports and the circumferential valve openings. Another problem with prior art rotary valve designs is the inability to vary the compression ratio and the flow rate of the fuel-air mixture into the working volume of the piston cylinder.

OBJECTS AND SUMMARY OF THE INVENTION

It is an object of the present invention to provide a rotary valve system for internal combustion engines to obviate the problems and limitations of the prior art systems.

It is a further object of the present invention to provide a rotary valve system which has the ability to adjust the amount of fuel-air mixture entering the combustion chambers of an internal combustion engine.

Another object of the present invention is to provide a rotary valve system with the ability to adjust the timing of the intake of fuel-air mixture entering the combustion chambers of an internal combustion engine.

Yet another object of the present invention is to provide a rotary valve system which does not require reciprocating parts so as to operate more effectively, quieter, and with less wear.

An even further object of the present invention is to provide a rotary valve system which minimizes the number of required parts.

Yet a further object of the present invention is to increase the engine volumetric efficiency by minimizing the restriction of the flow of air into the cylinder chamber inherent in poppet valve designs.

A yet even further object of the present invention is to increase the fuel efficiency of an engine by providing a rotary valve system which allows more complete combustion of the fuel-air mixture within the combustion chamber.

Additional objectives and advantages of the invention will become more apparent hereinafter.

In accordance with the present invention, there is provided a rotary valve system for internal combustion engines primarily comprising a rotary valve body mounted within a valve sleeve, which is in turn mounted within a longitudinal bore extending through an intake and exhaust manifold. The intake and exhaust manifold consists of a cylindrical through bore extending between opposing endwalls, at least two manifold fuel intake passages and at least two manifold exhaust passages which extend through a sidewall of the manifold to the through bore, and at least two combustion cavities extending through a bottom wall of the manifold to the through bore. The valve sleeve, which is disposed within the manifold through bore, consists of a tubular sidewall with at least two sleeve fuel intake ports each in flow communication with one the manifold fuel intake passages of the manifold, at least two sleeve fuel outlet ports each in flow communication with one of the manifold combustion cavities, at least two sleeve exhaust inlet ports each in flow communication with one of the two combustion cavities, and at least two sleeve exhaust outlet ports each in flow communication with one of the two manifold exhaust passages extending through said tubular sidewall. The rotary valve body, which is disposed within the tubular valve sleeve, consists of a tubular valve cylinder forming a fuel intake chamber and has at least two rotary valve fuel intake ports each adapted for flow communication with one of the two sleeve fuel intake ports and one of the two sleeve fuel outlet ports, at least two valve exhaust inlet ports each adapted for flow communication with one of the two sleeve exhaust inlet ports, and at least two valve exhaust outlet ports each adapted for flow communication with one of the two sleeve exhaust outlet ports extending through a sidewall of the tubular valve cylinder. In the preferred embodiment, there are four of each respective passage and/or port in the manifold, valve sleeve and rotary valve, which would be used for operating four or eight cylinder engines. A pulley for continuously rotating the rotary valve body is attached to a closed end of the valve body and is disposed outside of the manifold. A cylindrical plate is mounted to one end of the tubular valve sleeve and connected to this plate is a first controller for turning the valve sleeve about a longitudinal axis of the manifold through bore and a second controller for moving the valve sleeve along this same axis, these controllers preferably being servomotors controlled by means of a computer. The adjustment of the valve sleeve by means of these controllers provides the capability of adjusting the amount of fuel mixture entering the combustion chambers of the engine and the timing of the intake of such mixture.

Further in accordance with the present invention, there is provided a method of intaking fuel mixture into, and evacuating exhaust gas from, an internal combustion engine. During the intake stroke of an engine piston, fuel mixture is intaken into one of a plurality of manifold fuel intake passages of an intake and exhaust manifold and is directed from the fuel intake passage into an associated sleeve fuel intake port. The mixture is then directed from the sleeve fuel intake port, through an associated rotary valve fuel intake port, into a fuel intake chamber extending through the valve cylinder. Finally, the fuel mixture is directed out the intake chamber through a second rotary valve fuel intake port, through an associated sleeve fuel outlet port, and into an associated combustion cavity extending through the intake and exhaust manifold for delivery to an associated combustion chamber. After combustion of the fuel mixture, the exhaust gases are directed from the combustion chamber, through the combustion cavity, and into an associated sleeve exhaust inlet port. The exhaust gas is then directed from the sleeve exhaust inlet port, through an associated rotary valve exhaust inlet port of an exhaust chamber, and into the exhaust chamber, which is contained in the rotary valve body. Finally, the exhaust gas is directed from the exhaust chamber, through its rotary valve exhaust outlet port, through an associated sleeve exhaust outlet port, and into an associated manifold exhaust passage for further evacuation from the engine.

Yet further in accordance with the present invention, there is provided an alternative embodiment of a rotary valve system primarily comprising a rotary valve body mounted inside an intake and exhaust manifold, with the valve body and manifold constructed substantially identical to the first embodiment. This embodiment operates in a manner similar to the first embodiment as described above except that intake and exhaust gases do not flow through sleeve openings and there is no ability to adjust the amount of fuel-air mixture or the timing of the intake of such mixture.

Even further in accordance with the present invention, there is provided a rotary valve body for use in a rotary valve system of an internal combustion engine, comprising a tubular valve cylinder forming a fuel intake chamber and having at least two rotary valve fuel intake ports and two exhaust pockets. The exhaust pockets are attached to the sidewall of the rotary valve body so that a curved wall of the pocket is flush with the sidewall and the pocket is substantially disposed within the internal volume of the valve body. Each exhaust pocket contains an exhaust chamber, defined as the internal volume of the enclosed pocket, and has one rotary valve exhaust inlet port and one rotary valve exhaust outlet port extending through the curved sidewall of the pocket. Preferably, the intake ports are constructed so that each has a first edge extending partially about the circumference of the tubular valve cylinder, a second edge longer than the first edge, also extending partially about the circumference of the tubular valve cylinder, and two equilateral edges which curve inward toward each other and connect with the ends of the first and second edges.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

First Embodiment

Figure 1:
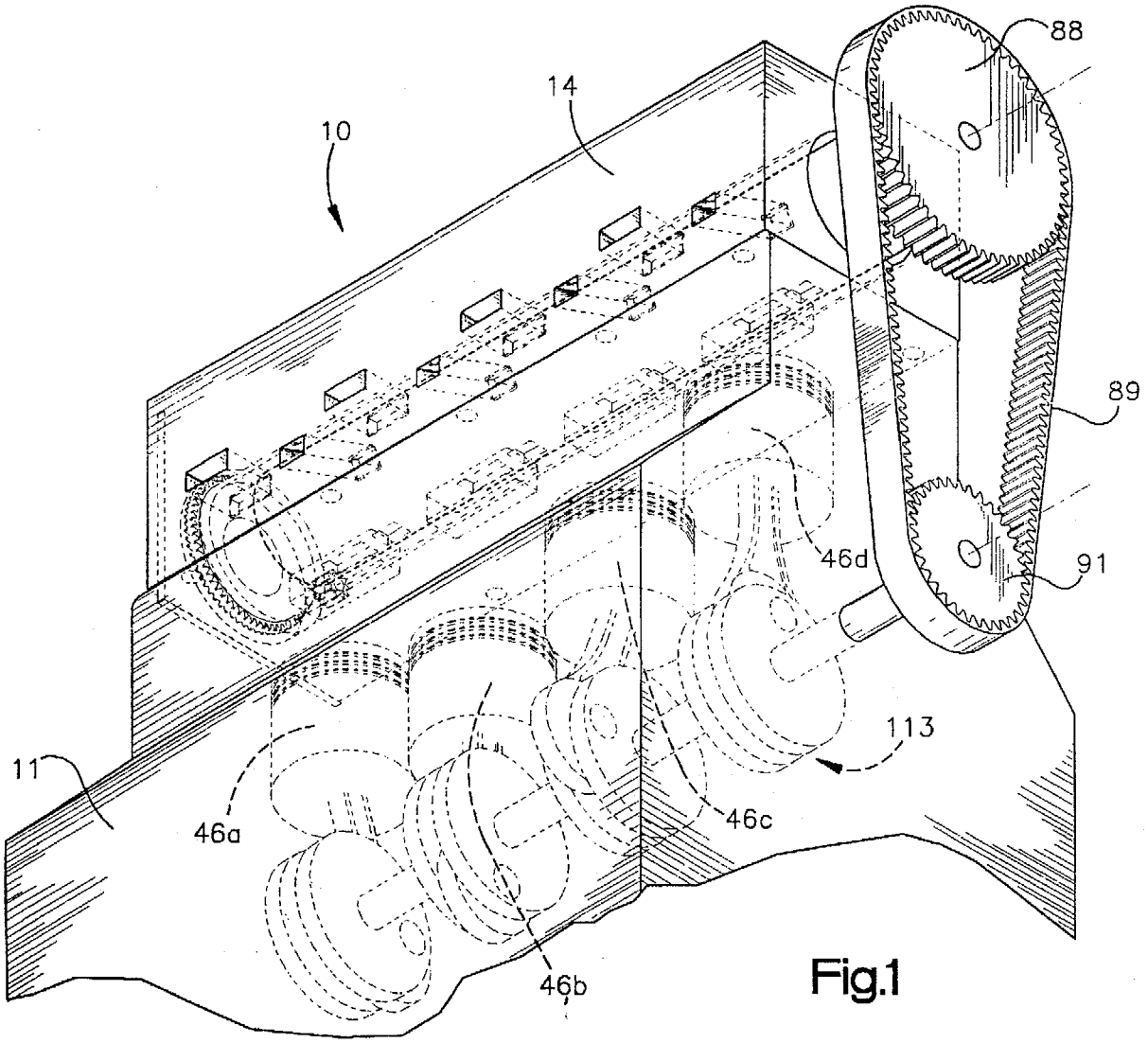
FIG. 1 is a perspective view of a first embodiment of a rotary valve system of the present invention shown mounted to a typical four cylinder internal combustion engine.
Figure 2:
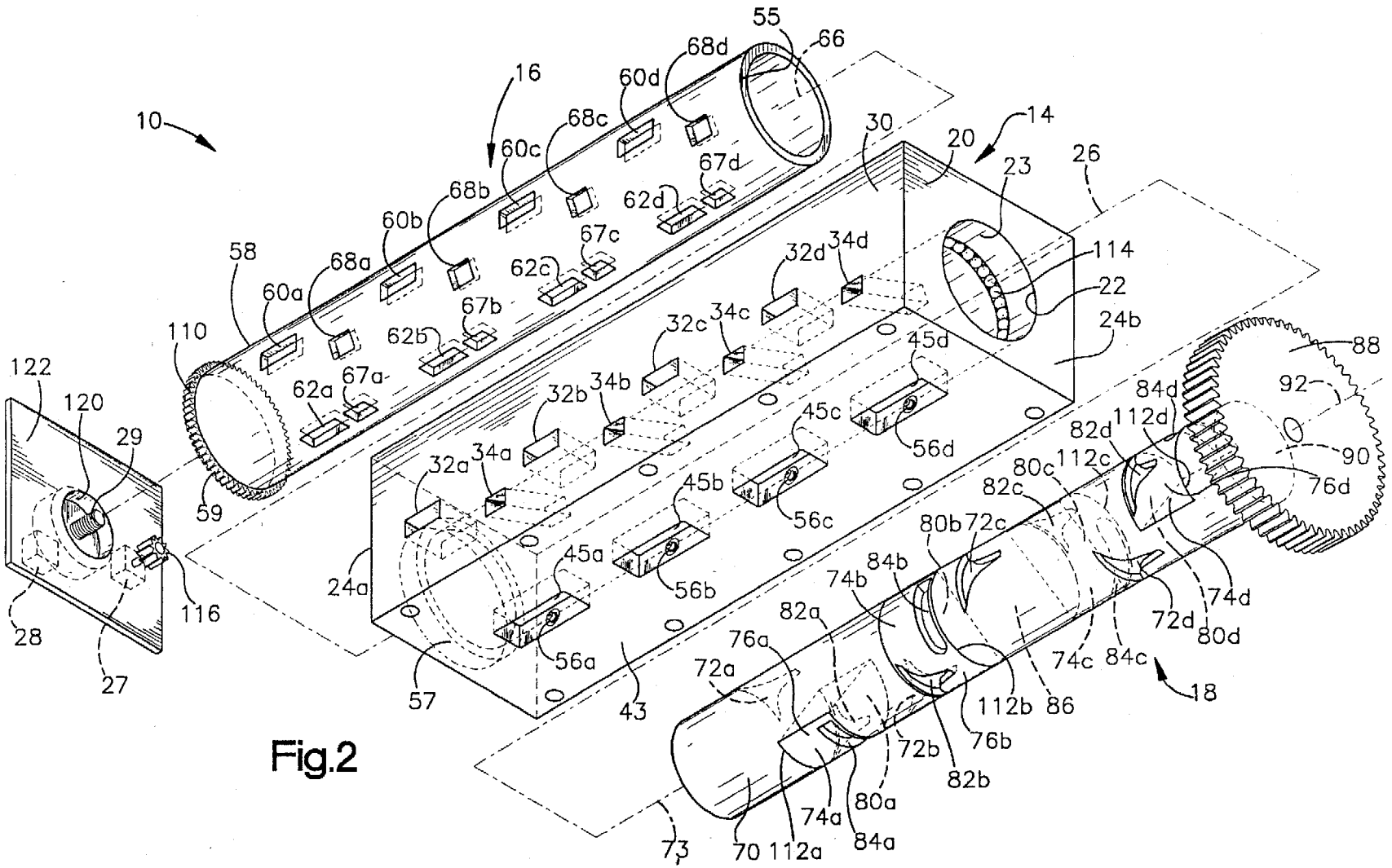
FIG. 2 is an exploded perspective view of the first embodiment of a rotary valve system according to the present invention in an embodiment for use with four engine cylinders.
Figure 3:
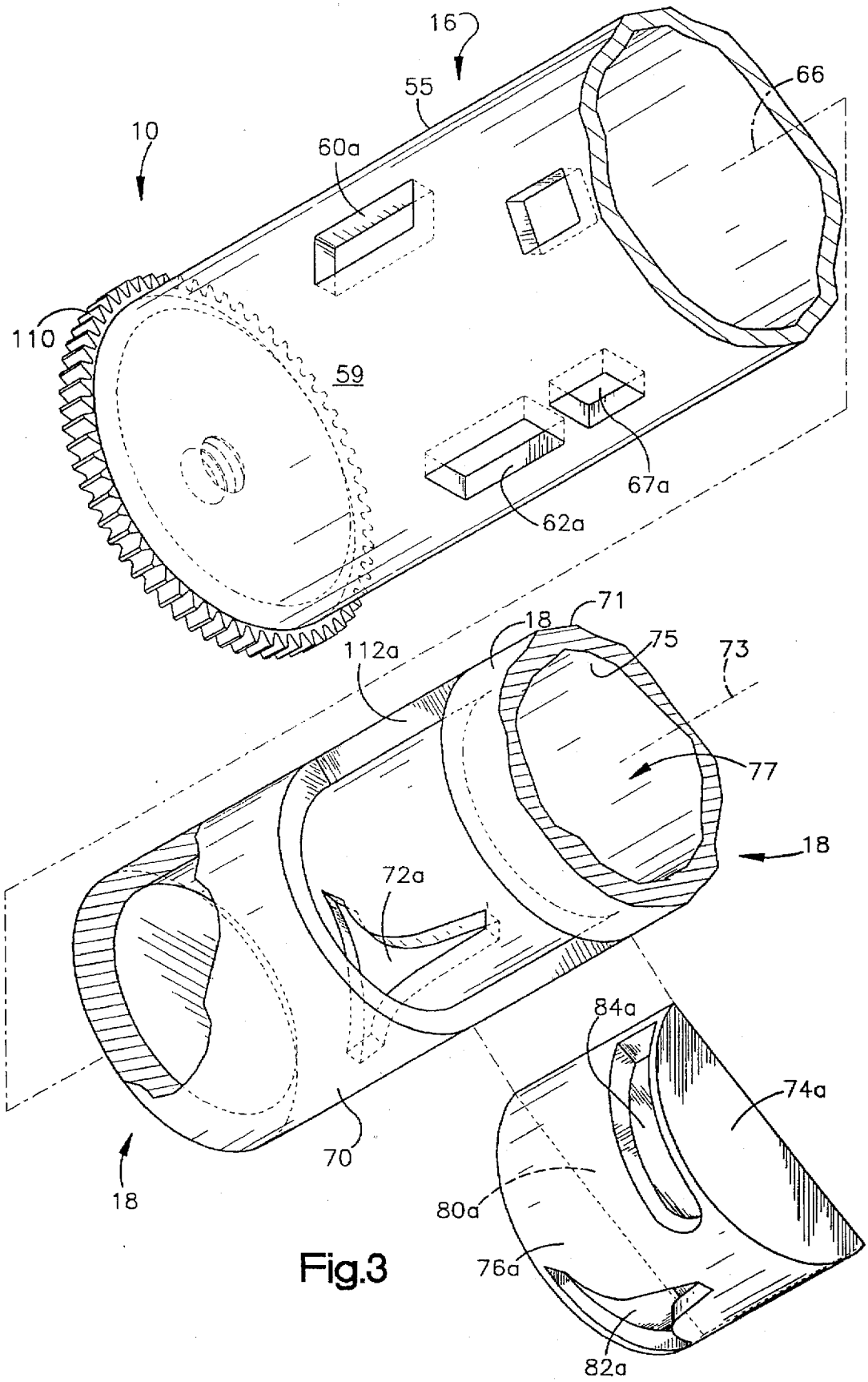
FIG. 3 is a perspective view of sections of a valve sleeve and a rotary valve body.

Referring to FIG. 1, a perspective view of the a rotary valve system 10 is shown mounted to a typical four-stroke internal combustion engine 11, illustrated in the four cylinder embodiment. While the description of the preferred embodiment will be generally directed towards a four-stroke internal combustion engine, it is to be understood that rotary valve system 10 is equally applicable to a two-stroke engine or any other engine having intake and exhaust valves. Referring to FIGS. 2 and 3, rotary valve system 10 consists primarily of an intake and exhaust manifold 14, a valve sleeve 16, and a rotary valve body 18.

As shown in to FIG. 2, intake and exhaust manifold 14 is comprised of a manifold block 20 with a cylindrical through bore 22 extending along a longitudinal axis 26 from a first end wall 24*a* to a second opposing end wall 24*b*. Through bore 22 is located in manifold block 22 so that longitudinal axis 26 is perpendicular to both end walls 24*a* and 24*b*. Extending through manifold block 20 are a plurality of fuel intake passages 32*a*, 32*b*, 32*c*, 32*d* (32*a*–32*d*) and an equal number of exhaust passages 34*a*, 34*b*, 34*c*, 34*d* (34*a*–34*d*). Each intake passage 32*a*–32*d* extends through side wall 30 of manifold block 20 and through cylindrical wall 23 of through bore 22. Each exhaust passage 34*a*–34*d* extends through side wall 30 of manifold block 20 and through cylindrical wall 23 of through bore 22. Referring to FIGS. 2, 5, and 6A–6B, a plurality of combustion cavities 45*a*, 45*b*, 45*c*, 45*d* (45*a*–45*d*) extend through the bottom wall 43 of manifold block 20 and through cylindrical wall 23 of through bore 22 to piston bores 42*a*, 42*b*, 42*c*, 42*d* (42*a*–42*d*) located in an engine block 11 to form combustion chambers 44*a*, 44*b*, 44*c*, 44*d* (44*a*–44*d*) between pistons 46*a*, 46*b*, 46*c*, 46*d* (46*a*–46*d*) and combustion cavities 45*a*–45*d*, respectively. Combustion cavities 45*a*–45*d* are preferably rectangular in shape, although it is within the scope of the invention to make the combustion cavities any other shape, for example, a domed-cylinder or of a hemispherical shape. Each combustion chamber 45*a*–45*d* also has at least one sparking mechanism 56*a*, 56*b*, 56*c*, 56*d* (56*a*–56*d*), such as a conventional spark plug, extending therein.

A counterbore 57, concentric with axis 26, is disposed in wall 24*a* of manifold block 20 to receive the cylindrical end of valve sleeve 16, as explained below. A first controller 27, preferably mounted to the manifold block 20, is operably connected by conventional means to valve sleeve 16 as explained below. A second controller 28, preferably mounted to manifold block 20, is operably connected by conventional means to one end of valve sleeve 16 as explained below.

In the exploded illustration of the first embodiment of the present invention, as shown in FIG. 2, the manifold block 20 has four combustion cavities 45*a*–45*d*, four fuel intake passages 32*a*–32*d*, and four exhaust passages 34*a*–34*d*. This embodiment is adapted for use to operate four cylinder engines or "V-eight" cylinder engines, the V-eight engines requiring two rotary valve systems 10 for each of the four cylinders which are in-line. However, it is within the scope of the invention to construct the manifold block with three combustion cavities, three fuel intake passages. Two of the latter rotary valve systems can be used to operate a "V-six" cylinder engine. Furthermore, it is within the scope of the invention to construct the manifold block of the disclosed rotary valve system with any number of combustion cavities and a corresponding number of fuel intake passages and exhaust passages, the number of which corresponds to the number of cylinder heads of the engine for which the rotary valve system is designed.

Figure 4A:
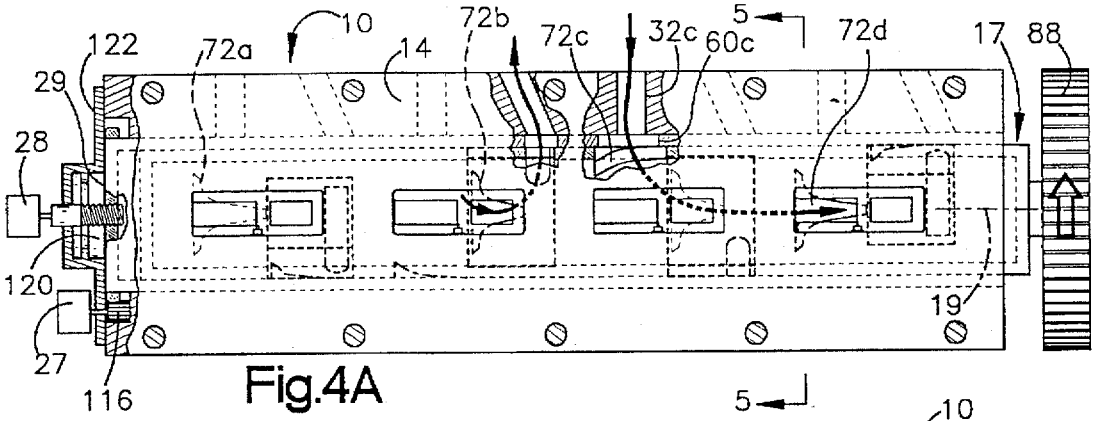
FIGS. 4A–4D are each a bottom view of the first embodiment of the rotary valve system, showing four different positions of the rotary valve system to illustrate its operation.
Figure 4B:
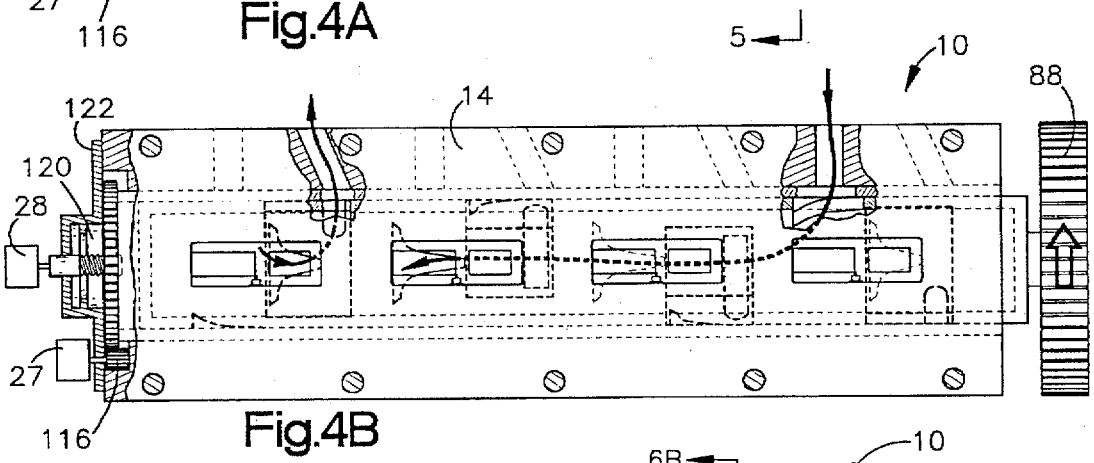
Figure 4C:
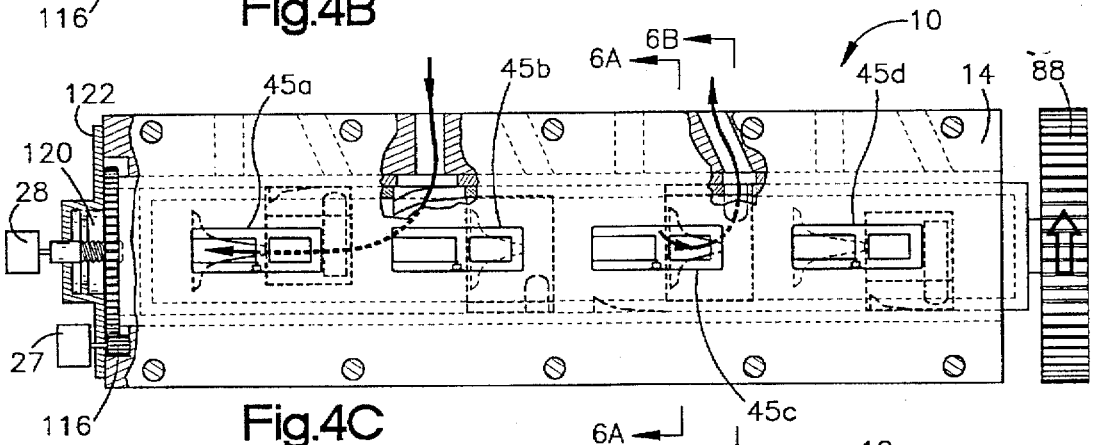
Figure 4D:
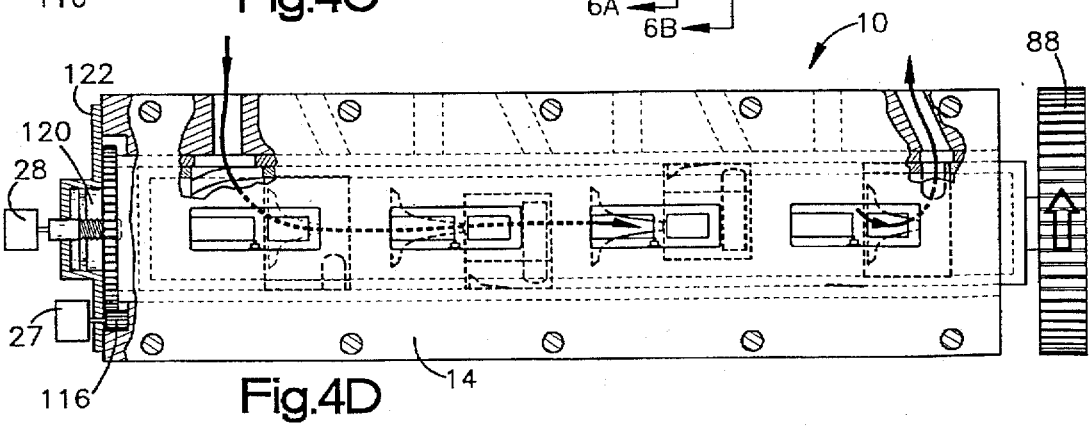
Figure 5:
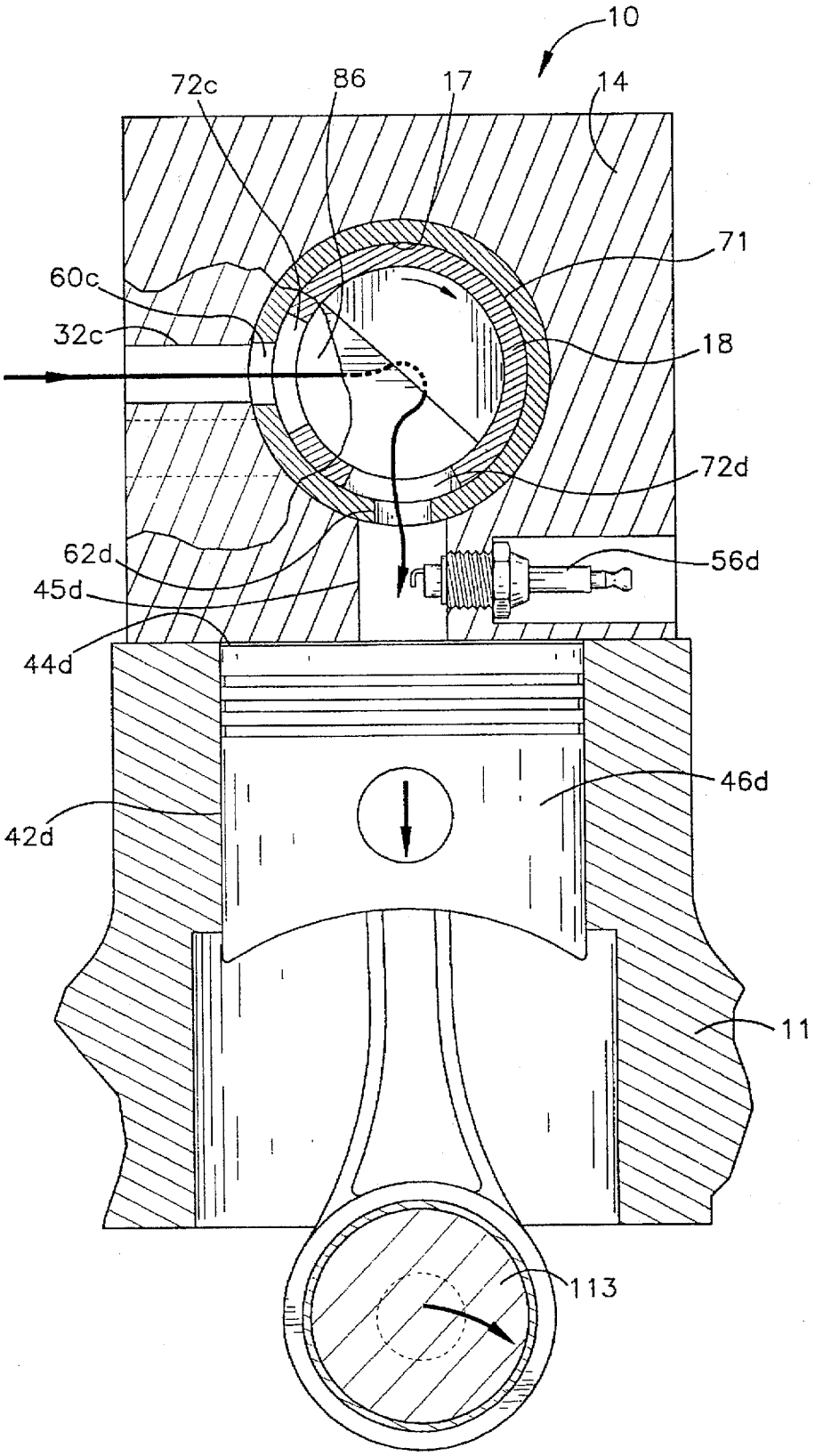
FIG. 5 is a cross-sectional view through line 5—5 of FIG. 4A illustrating the intake ports of the valve body, the valve sleeve, and the intake and exhaust manifold to illustrate the intake process of the valve system.

Referring to FIG. 2, valve sleeve 16 is comprised of a tubular sleeve 58 formed of a tubular sidewall 55 that is open at one end and closed at the opposite end. The outside diameter of tubular sidewall 55 is slightly less than the inside diameter of the cylindrical through bore 22 of manifold block 20. As shown in FIGS. 3 and 5, sleeve fuel intake ports 60*a*, 60*b* 60*c*, 60*d* (60*a*–60*d*) and corresponding sleeve fuel outlet ports 62*a*, 62*b*, 62*c*, 62*d* (62*a*–62*d*) extend through the sidewall 55 of tubular sleeve 58. Each sleeve intake port 60*a*–60*d* and sleeve outlet port 62*a*–62*d* is located about tubular sleeve cylinder 58 so that when the valve sleeve 16 is assembled in the bore 22 of manifold 20, each sleeve fuel intake port 60*a*–60*d* maintains flow communication with a corresponding fuel intake passage 32*a*–32*d*, respectively, of manifold block 20 and each sleeve outlet port 62*a*–62*d* maintains flow communication with a corresponding combustion cavity 45*a*–45*d* of manifold block 20. A plurality of sleeve exhaust inlet ports 67*a*, 67*b*, 67*c*, 67*d* (67*a*–67*d*) and sleeve exhaust outlet ports 68*a*, 68*b*, 68*c*, 68*d* (68*a*–68*d*) extend through the sidewall 55 of cylinder 58. Each sleeve exhaust inlet port 67*a*–67*d* and each sleeve exhaust outlet port 68*a*–68*d* is located about tubular sleeve cylinder 58 so that when the valve sleeve 16 is assembled in the valve bore 22 of manifold 20, each sleeve exhaust inlet port 67*a*–67*d* maintains flow communication with successive combustion cavities 45*a*–45*d*, respectively, in manifold 20 and each sleeve exhaust outlet port 68*a*–68*d* maintains flow communication with successive manifold exhaust outlet passage 34*a*–34*d*, respectively. The exact number of sleeve fuel intake ports 60*a*–60*d*, sleeve fuel outlet ports 62*a*–62*d*, sleeve exhaust inlet ports 67*a*–67*d*, and sleeve exhaust outlet ports 68*a*–68*d*, corresponds to the number of combustion chambers (and thus engine cylinders), and four of each are used with the system illustrated in valve sleeve 16 in FIGS. 2 and 4A–4D for a four cylinder engine. As shown in FIGS. 2, 3, and 4A–4D, a pattern of gear teeth 110 are located about the outer circumference of a cylindrical plate 59 having a larger outer diameter than sleeve cylinder 58 and closing one end of tubular sleeve 58.

The preferred embodiment of the present invention, as discussed above, includes four sleeve fuel intake ports 60*a*–60*d*, four sleeve fuel outlet ports 62*a*–62*d*, four sleeve exhaust inlet ports 67*a*–67*b* and four sleeve exhaust outlet ports 68*a*–68*d* extending through the sidewall 55 of tubular sleeve cylinder 58 of valve sleeve 16. However, it is within the scope of the invention to construct valve sleeve 16 with any number of sleeve fuel intake ports and an equal number of sleeve fuel outlet ports and sleeve exhaust inlet and outlet ports, the number of which corresponds to the number of combustion cavities 45*a*–45*d* in the intake and exhaust manifold 14.

Referring to FIGS. 2 and 3, a rotary valve body 18 consists of a tubular valve cylinder 70 which typically has an axial length greater than the axial length of valve bore 22 and has an outside diameter slightly less than the inside diameter of valve sleeve 16. As shown in FIG. 3, a plurality of fuel intake ports 72*a*, 72*b*, 72*c*, 72*d* (72*a*–72*d*) extend through the sidewall of valve cylinder 70 from outer valve wall 71 to inner valve wall 75. The exact number of fuel intake ports 72*a*–72*d* corresponds to the number of combustion cavities 45*a*–45*d*, and thus the number of engine cylinders. Although it is within the scope of the invention to construct fuel intake ports 72*a*–72*d* of any shape, in the preferred embodiment, each intake port 72*a*–72*d* is shaped somewhat like a bilateral triangle with the unequal side extending circumferentially, the triangle being truncated at the common angle of the equilateral sides, with the equilateral sides being curved inward (see FIG. 3). Referring to FIGS. 2 and 3, a plurality of exhaust pockets 74*a*, 74*b*, 74*c*, 74*d* (74*a*–74*d*) are each mounted in a corresponding opening 112*a*, 112*b*, 112*c*, 112*d* (112*a*–112*d*) of valve cylinder 70, by means such as welding, such that an outer curved wall 76*a*, 76*b*, 76*c*, 76*d* (76*a*–76*d*) of exhaust pockets 74*a*–74*d*, respectively, conform with outer valve wall 71 of valve cylinder 70 and such that the remainder of exhaust pockets 74*a*–74*d* are located within the internal volume 77 enclosed by inner wall 75 of valve cylinder 70. Each exhaust pocket 74*a*–74*d* encloses an exhaust chamber 80*a*, 80*b*, 80*c*, 80*d* (80*a*–80*d*) and has a valve exhaust inlet port 82*a*, 82*b*, 82*c*, 82*d* (82*a*–82*d*) and a valve exhaust outlet port 84*a*, 84*b*, 84*c*, 84*d* (84*a*–84*d*) extending through a corresponding outer curved wall 76*a*–76*d* of exhaust pocket 74*a*–74*d*. The number of intake ports 72*a*–72*d* and exhaust pockets 74*a*–74*d*, each having a corresponding valve exhaust inlet port 82*a*–82*d* and a corresponding valve exhaust outlet port 84*a*–84*d*, corresponds to the number of combustion cavities 45*a*–45*d* and thus the number of engine cylinders. The relative location, about the circumference of the valve body 18, of the fuel intake ports 72*a*–72*d* depends on the number of piston cylinders which the valve system is serving; for two cylinders, the fuel intake ports (72*a*–72*b*) are 180° apart, for three cylinders, the fuel intake ports (72*a*–72*c*) are 120° apart, and for four cylinders, the fuel intake ports (72*a*–72*d*) are 90° apart. A fuel intake chamber 86 in rotary valve body 18 is defined by the internal volume 77 less the volume of space occupied by the exhaust pockets 74*a*–74*d*. A pulley 88 is attached to closed end 90 of valve cylinder 70 such that the rotational axis 92 of pulley 88 is coaxial with axis 73 of valve cylinder 70. A bearing 114, such as a roller bearing, is disposed in the cylindrical wall 23 of manifold 14 and spaced from end wall 24*b*, to support the end of rotary valve body 18. Note that the open end of valve sleeve 16 does not contact bearing 114.

In the preferred embodiment of the present invention discussed above, there are four fuel intake ports 72*a*–72*d* extending through tubular valve cylinder 70 and four exhaust pockets 74*a*–74*d* attached to tubular valve cylinder 70 of rotary valve body 18. However, it is within the scope of the invention to construct rotary valve cylinder 18 to have any number of fuel intake ports and an equal number of exhaust pockets, the number of which corresponds to the number of combustion chambers 44 in the intake and exhaust manifold 14.

Rotary valve system 10 is constructed as follows: first, valve sleeve 16 is inserted into valve bore 22 of manifold block 20 from the end wall 24*a* so that the cylindrical end 110 is located within counterbore 57. Then, rotary valve body 18 is assembled into the open end of valve sleeve 16 from end wall 24*b* of manifold block 20 so that axis 73 of valve body 18 is coincident with axis 66 of valve sleeve 16 to form a valve assembly 17 with an assembly axis 19 coincident with bore axis 26 of valve bore 22 through manifold block 20. When the valve sleeve 16 is assembled in the rotary valve system 10, gear teeth 110 mesh with a driving gear 116 connected to a servomotor 27. A lead screw 29, operably connected to a servomotor 28, extends into a recess 120 formed by a plate 122 secured to end wall 24*a* of manifold 14. Lead screw 29 is affixed to the plate 59, as shown in FIG. 4A, at one end of tubular sleeve cylinder 58. The rotary valve system 10 is mounted to an engine block 11 by placing the mounting bottom wall 43 of manifold block 20 onto the engine block 11 above the cylinder heads so that the cylinder heads of the engine block align with the combustion cavities 45*a*–45*d* of the manifold block 20. The manifold block 20 is secured to the engine block by conventional means such as bolts in through holes disposed about the periphery of the manifold block. A belt 89 is attached to pulley 88 of rotary valve body 18 to drive pulley 88 with a second pulley 91 secured to the crankshaft 113 of engine 11. First servomotor 27 and second servomotor 28 are connected through electrical cabling to a computer (not shown) for controlling the position of the valve sleeve 16, as discussed below. A lubrication system (not shown) allows a standard lubricant to enter through the manifold block 20 and provides lubrication for the whole rotary valve system and, in particular, between outer surface 71 of tubular valve cylinder 70 and the inner surface of sidewall 55 of valve sleeve 16.

The operation of the rotary valve system of the present invention is illustrated in FIGS. 4A–4D, 5, 6A, 6B, 7, 8, 9, 10A–10C, 11A–11C, 12A and 12B, for a four cylinder engine operating under the four-stroke process. However, it is within the scope of the present invention to use the disclosed rotary valve system 10 to operate an internal combustion engine with any number of cylinders and/or operating under the two-stroke process.

Referring to FIGS. 4A–4D, and 5, as the pistons 46*a*–46*d* cycle within their respective piston bores 42*a*–42*d*, rotary valve body 18 is continuously rotating by the operation of pulley 88, which is belt-driven by the crankshaft 113 of the engine 11. The rotation of valve body 18 is coordinated with the timing of the piston cycles, which preferably operate under the four stroke system. The processes of in taking the fuel mixture, typically the fuel-air mixture, into the combustion chamber and evacuating exhaust gases from the combustion chamber 44*a*–44*d* are outlined below as two separate operations, but both processes occur simultaneously and continuously in different piston cylinders, as shown in FIGS. 4A–4D.

Referring to FIGS. 4A and 5, the process of intaking the fuel-air mixture into the combustion chamber 44*d* begins as follows: due to the relative location of the individual intake ports 72*a*–72*d* about the circumference of the valve body 18 and the coordination of the rotation of the valve body 18 with the timing of the engine operation, one valve intake port 72*c* will cross a sleeve intake port 60*c*, thus opening to the associated manifold intake passage 32*c*, while another intake port, i.e., intake port 72*d* simultaneously crosses its associated sleeve outlet port 62*d*, thus providing a fuel path through combustion cavity 45*d* to combustion chamber 44*d*. At this time, the piston 46*d* in the piston bore 42*d* below the combustion cavity 45*d* is moving downward for an intake stroke. The partial vacuum created by the downward travel of the piston 46*d* in the piston bore 42*d* draws the fuel-air mixture from the intake passage 32*c* of manifold 14 to the combustion chamber 44d directly above the piston 46d by way of the path outlined below.

The flow of the fuel-air mixture proceeds along the following path during intake, as herein illustrated by a path between a first intake port 72c and a second intake port 72d (see FIG. 5). First, fuel-air mixture enters intake and exhaust manifold 14 through manifold fuel intake passage 32c, and then flows through sleeve fuel intake port 60c of valve sleeve 16, through valve fuel intake port 72a as the latter crosses the sleeve intake port 60c, and into the intake chamber 86 of rotary valve body 18. Next, the fuel-air mixture flows from the intake chamber 86, through a second intake port 72d as it crosses it associated sleeve fuel outlet port 62d, through the combustion cavity 45d into the combustion chamber 44d. Rotation of valve body 18 causes valve wall 71 of the rotary valve body 18 to seal the valve sleeve outlet port 62d, thus sealing the combustion cavity 45d and causing combustion chamber 44d to be an enclosed volume during the compression and power strokes of the piston cycle.

Figure 6A:
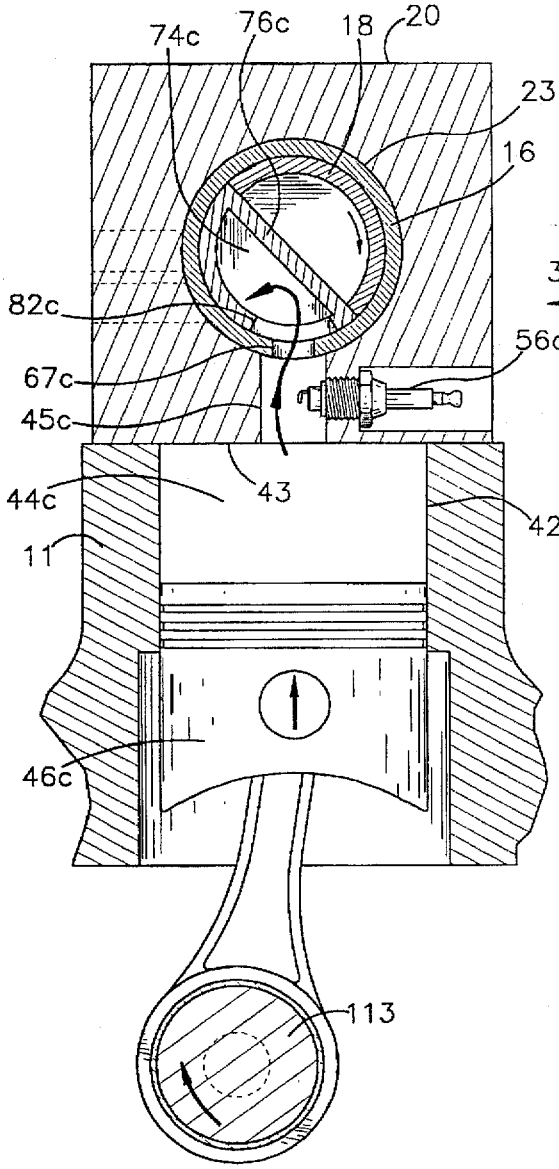
FIG. 6A is a view through line 6A—6A of FIG. 4C illustrating the exhaust flowing from the combustion chamber to the exhaust pocket.
Figure 6B:
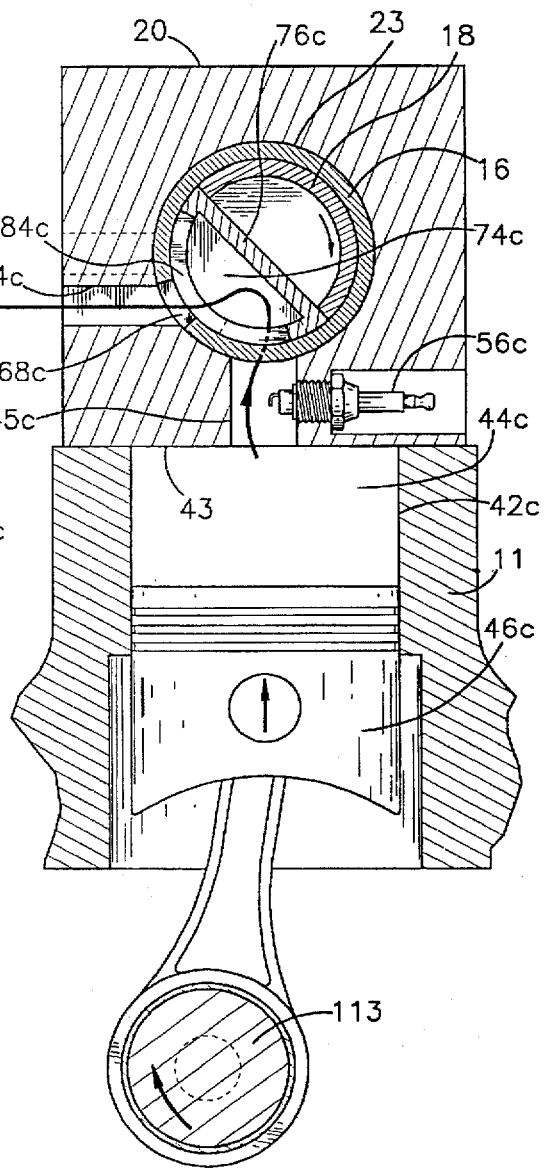
FIG. 6B is a view through line 6B—6B of FIG. 4C illustrating the exhaust flowing from the exhaust pocket through the manifold.

Referring to FIGS. 6A and 6B, the evacuation of exhaust gases from the combustion chamber 44c is accomplished by the following operation of the rotary valve system 10. The rotation of rotary valve body 18 is timed so that during the exhaust stroke of engine piston 46c, the valve exhaust inlet port 82c of valve body 18 passes across the associated sleeve exhaust inlet port 67c; exhaust gasses are then able to flow out the combustion chamber 44c through the combustion cavity 45c, through the sleeve exhaust inlet port 67c, through the valve exhaust inlet port 82c, and into the exhaust chamber 74c of exhaust pocket 76c (see FIG. 6A). At the same time as valve exhaust inlet port 82c passes across its associated sleeve exhaust inlet port 67c, valve exhaust outlet port 84c, as shown in FIG. 6B, passes across the associated sleeve exhaust outlet port 68c, enabling the exhaust gases to flow from the exhaust chamber 74c, through valve exhaust outlet port 84c, through the sleeve exhaust outlet port 68c, and into the manifold exhaust passage 34c of the manifold block 20.

The rotary valve system 10 can be constructed to accommodate any desired firing order in the engine cylinders by altering the arrangement of the fuel intake ports 72a–72b about the circumference of valve cylinder 70. For example, in a four cylinder valve arrangement wherein four fuel intake ports 72a–72d are located about outer valve wall 71 at 90 degrees from each other about the circumference of the valve cylinder, one rotary valve fuel intake port 72a–72d will be aligned with its associated sleeve fuel intake port 60a–60d, respectively, and associated manifold intake passage 32a–32d, respectively, allowing fuel-air mixture to flow into the fuel intake chamber 86 at the same time that another valve fuel intake port 72a–72d will be aligned with a corresponding sleeve fuel outlet port 62a–62d, and thus opening combustion cavity 45a–45d, to allow the fuel-air mixture to flow from the intake chamber 86 into the combustion chamber 44a–44d. Thus, the order of firing in the combustion chambers is dictated by the specific combination of valve fuel intake ports 72a–72d, i.e. which intake port is aligned with its associated sleeve fuel intake port 60a–60d when another valve intake port 72a–72d is aligned with its associated sleeve fuel outlet port 62a–62d. Therefore, the firing order for four cylinders could be one-two-three-four, one-three-two-four, one-four-two-three, one-two-four-three, one-three-four-two, or one-four-three-two, although the desired order will be limited by other considerations. The firing order illustrated in FIGS. 4A–4D is one-three-four-two.

Figure 7:
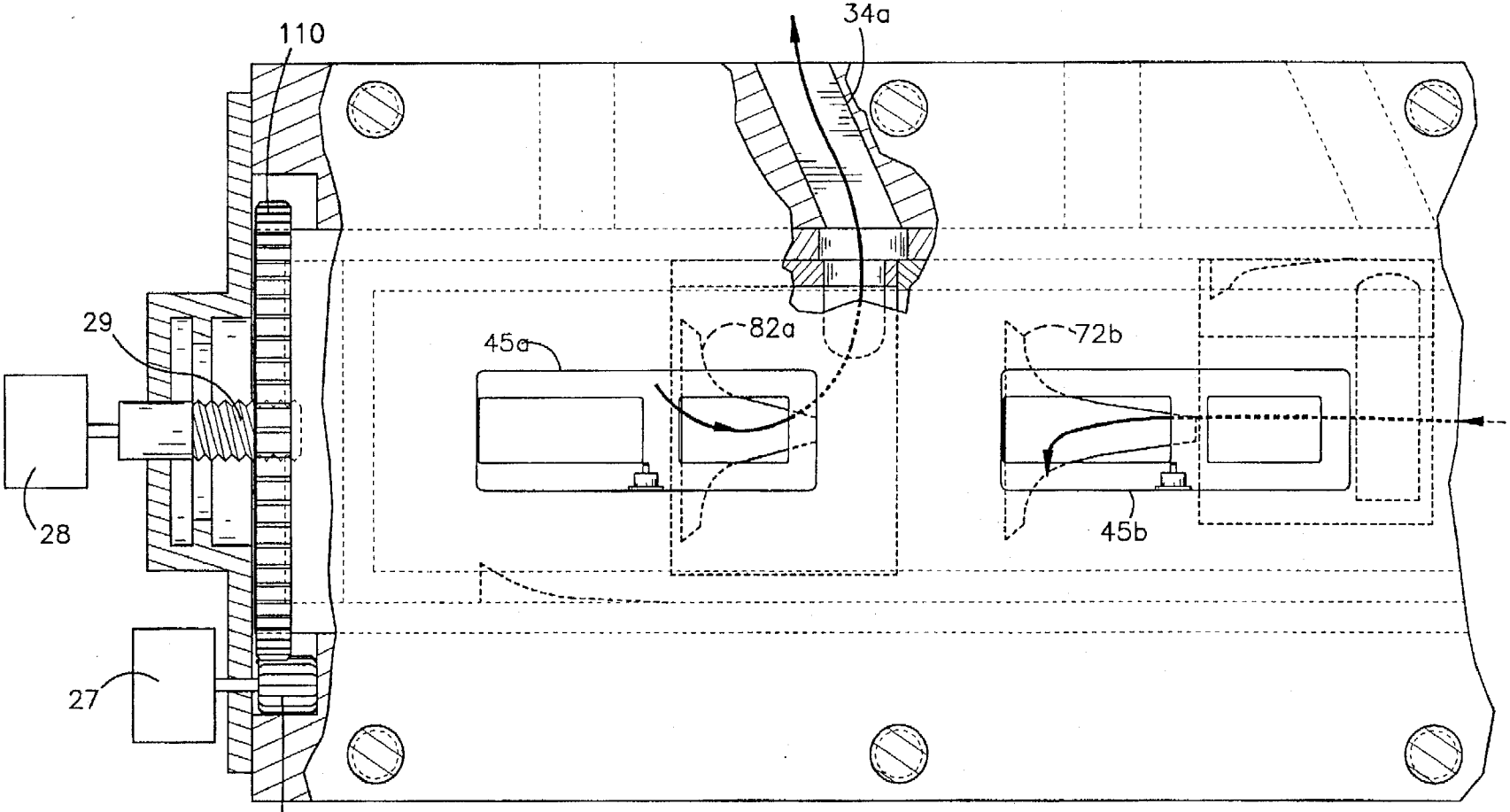
FIG. 7 is an enlarged view of a portion of FIG. 4B to illustrate the fuel delivered to one combustion chamber and the exhaust from another chamber.
Figure 8:
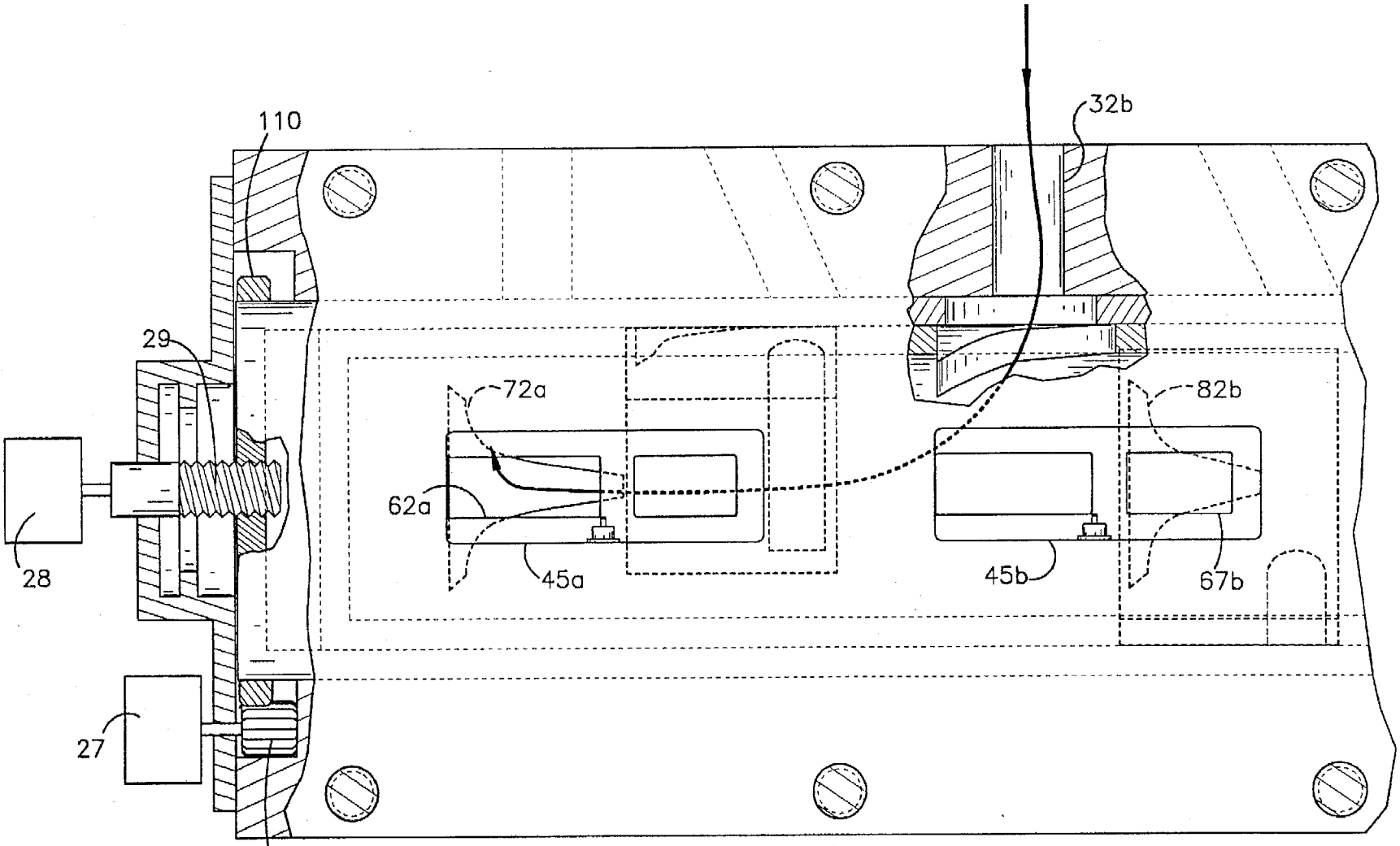
FIG. 8 is an enlarged view of a portion of FIG. 4C showing the rotary valve turned to a position where the valve sleeve is in a position where the maximum fuel mixture is delivered to the combustion chamber being exhausted in FIG. 4B.
Figure 9:
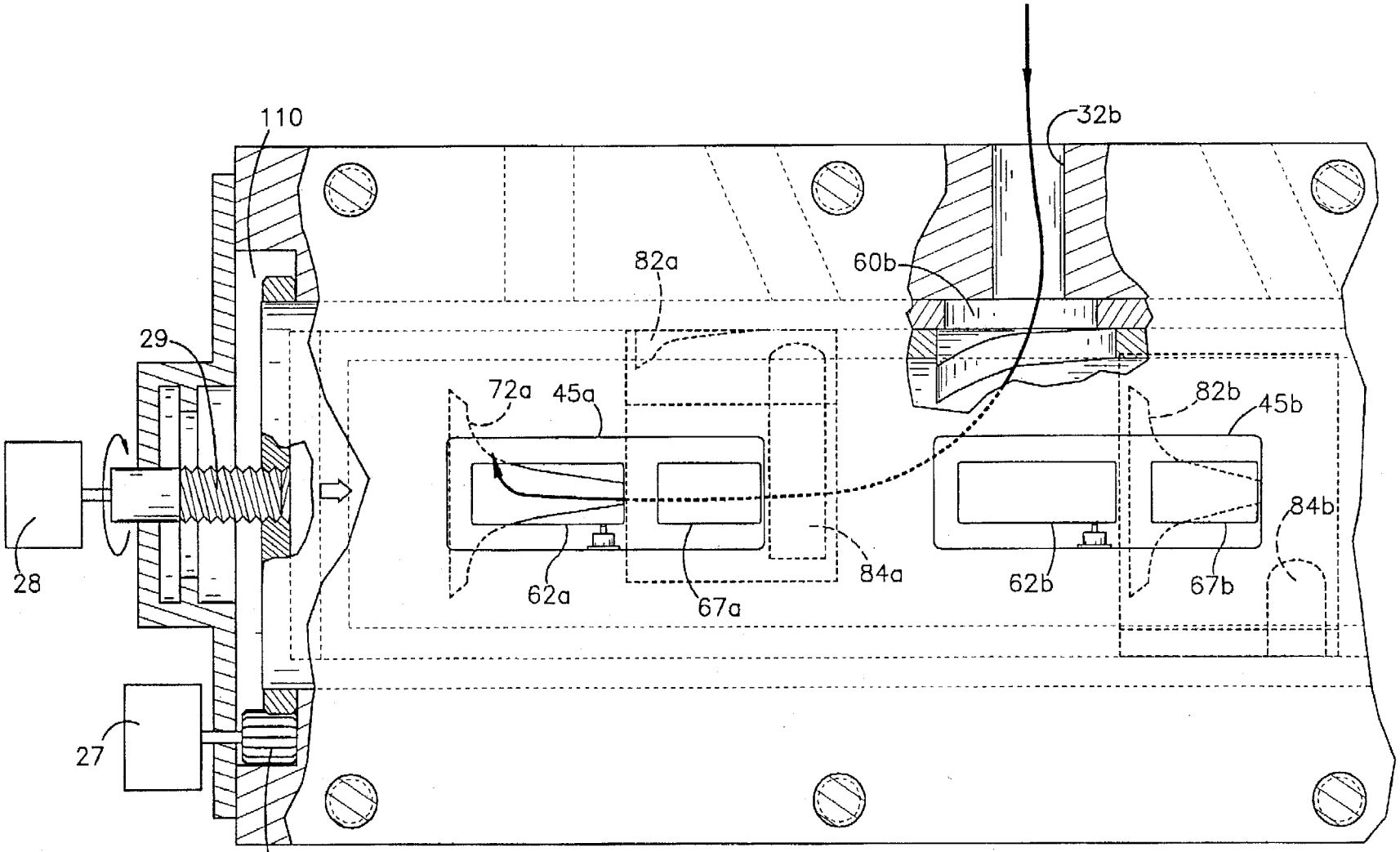
FIG. 9 is similar to FIG. 8 except that the valve sleeve is shown in a position where the least fuel is delivered to the combustion chamber.

One important feature of the first embodiment of the present invention is the ability to vary both the amount of fuel-air mixture entering the combustion chamber 44a–44d and the point during the intake stroke of the piston 46a–46c at which fuel-air mixture enters the combustion chamber by changing the position of the valve sleeve 16 relative to through bore axis 26 through manifold 20. As shown in FIGS. 7, 8, 9, 10A, 10B, 10C, 11A, 11B, and 11C, a variation of the axial position of valve sleeve 16 changes the size of each of the valve fuel intake ports 72a–72d of rotary valve body 18 that pass across the sleeve fuel intake port 60a–60d, respectively, and the sleeve fuel outlet port 62a–62d. This variation in the size of the flow passage through the overlapped sleeve fuel intake port 60a–60d and corresponding valve fuel intake port 72a–72d controls the mount of fuel-air mixture that is drawn from the manifold 20 and into the combustion chamber 44a–44c, i.e., the larger the flow area across the port, the more fuel-air mixture that can be drawn into the intake chamber 86 and then into the combustion chambers 44a–44c. FIGS. 7 and 8 illustrate the valve sleeve 16 in the leftward-most position, which allows for the maximum fuel-air inflow and enables complete evacuation of the exhaust gases through valve exhaust outlet ports 82a–82d. FIG. 9 illustrates the valve sleeve 16 in the rightward-most position, which allows for the minimum fuel-air inflow and results in the minimum exhaust gasses outflow through the valve exhaust inlet ports 82a–82d.

Figure 10A:
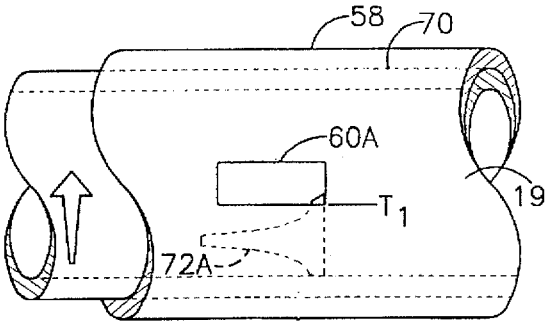
FIGS. 10A–10C are partial plan views showing an intake port of the rotary valve body and an opening in the valve sleeve, with the valve sleeve in a first axial position, illustrating the valve opening, maximum open, and valve closing positions.
Figure 11A:
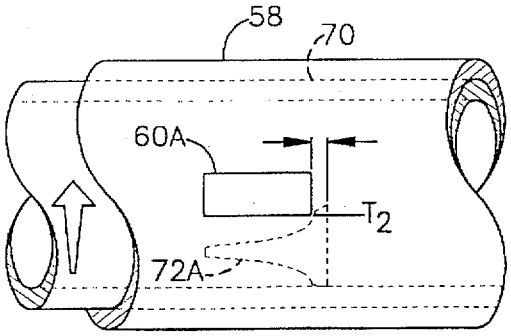
FIGS. 11A–11C are partial plan views showing an intake port of the rotary valve body and an opening in the valve sleeve, with the valve sleeve in a second axial position, illustrating the valve opening, maximum open, and valve closing positions.
Figure 10B:
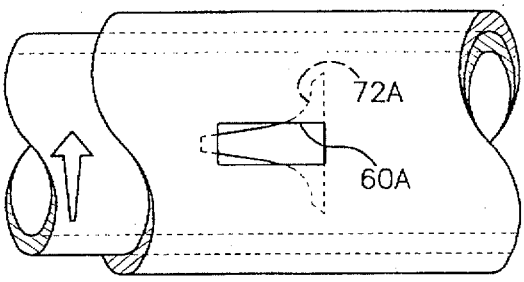
Figure 11B:
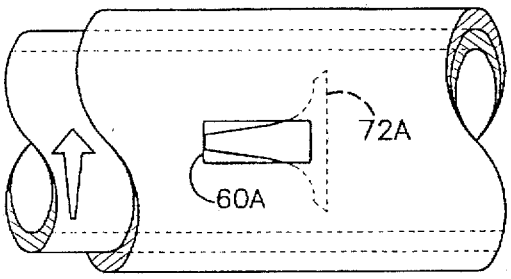
Figure 10C:
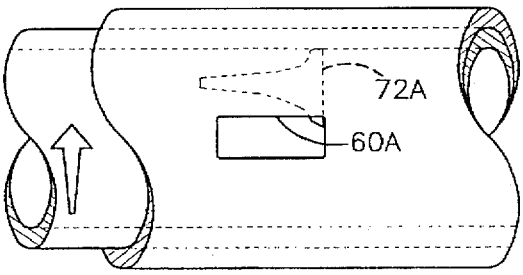
Figure 11C:
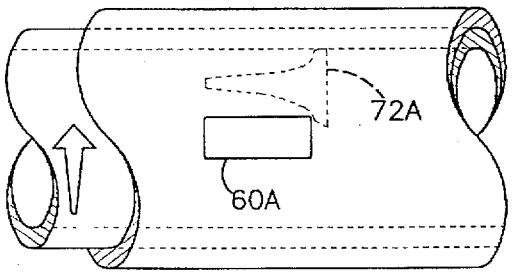

Furthermore, with intake ports 72a–72d shaped, such as in the preferred embodiment described above, besides controlling the point during the intake stroke of the pistons 46a–46d at which fuel-air mixture enters the combustion chambers 44a–44d, the duration of the fuel-air intake process can also be changed by the change in axial position of the valve sleeve 16 within the through bore 23 in manifold 20. Due to the variation in the size of the valve intake port 72a–72d along the axis of tubular valve cylinder 70, the point in the rotation of the rotary valve body 18, and thus the stroke of pistons 46a–46d, at which one intake port 72a–72d begins to pass across the corresponding sleeve intake port 60a–60d and another valve intake port begins to cross a corresponding sleeve outlet port 62a–62d is earlier when the valve sleeve 16 is positioned as shown in FIG. 10A than the point at which they would begin to cross if positioned as shown in FIG. 11A, i.e., the minimum sized opening. Also, the fuel-air inflow through valve sleeve 16 and rotary valve 18 will stop later in the intake stroke of the pistons 46a–46d when the valve sleeve 16 is positioned as in FIGS. 10A–10C, as shown in FIG. 10C, than when it is positioned as in FIGS. 11A–C, as shown FIG. 11C.

In the preferred embodiment, the adjustment of the axial position of valve sleeve 16 is accomplished by a computer controlled servomotor 28 actuating a lead screw 29 attached to one end of the tubular sleeve cylinder 58. The gear teeth of gear 116 are of sufficient width so that the gears 116 and 110 engage irrespective of the position of valve sleeve 16 in the bore 23 of manifold 14.

Figure 12A:
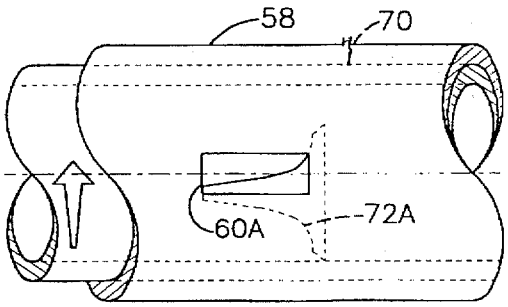
FIGS. 12A and 12B are partial plan views showing an intake port of the rotary valve body and an opening in the valve sleeve, with the valve sleeve in two angular positions, illustrating the capability of changing the timing of the intake of fuel-air mixture.
Figure 12B:
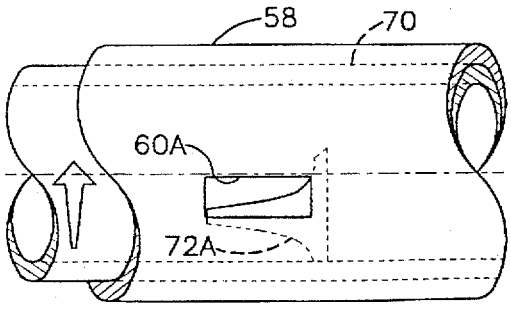

A second important feature of this embodiment of the present invention, as illustrated in FIGS. 12A and 12B, is the ability to adjust the point during the intake stroke of the piston at which the intake of fuel-air mixture occurs by adjusting the angular position of the valve sleeve 16 about its longitudinal axis 66 and with respect to through bore axis 26 extending through bore 23 of manifold 20. Referring to FIGS. 12A and 12B, by changing the angular position of valve sleeve 16, typically within a range of about 25°, the timing of the communication between both one intake port 72a–72d (only 72a is shown) of the rotary valve body 18 and the corresponding intake port 60*a*–60*d* of the sleeve 16 and a second valve intake port 72*a*–72*d* (not shown) and the associated sleeve outlet port 62*a*–62*d* (not shown), and thus with its associated valve combustion chamber 44*a*, is varied. For example, if the rotary valve body 18 is rotating counterclockwise and the angular position of the valve sleeve 16 is adjusted clockwise from the position shown in 12A to the position shown in 12B, one valve intake port 72*a* of the rotary valve body will align with its associated sleeve fuel intake port 60*a* and a second intake port 72*b* will align with it associated sleeve fuel outlet port 62*b* at a point earlier in the rotation of the valve body (and thus earlier in the intake stroke of the piston), thereby allowing the fuel-air mixture to enter the combustion chamber earlier in the intake stroke of the engine. In the preferred embodiment, the adjustment of the angular position of valve sleeve 16 is accomplished by means of a computer controlled servomotor 27 actuating drive gearing 116 that meshes with gear teeth 110 cut into the outer wall 59 of the valve sleeve 16 in a radial pattern.

Two other important features of the present invention result from the intake path of the fuel-air mixture. After entering the intake chamber 86 of rotary valve body 18 through a first of the valve fuel intake ports 72*a*–72*d*, the fuel-air mixture has to travel across at least one exhaust pocket 74*a*–74*d* before it can exit the intake chamber 86 through a second of the intake ports 72*a*–72*d* ( i.e., other than the intake port through which the fuel-air mixture entered). By traveling across at least one exhaust pocket 74*a*–74*d*, and usually a plurality of such exhaust pockets, the fuel-air mixture absorbs heat convectively that has been conducted through the pocket walls from the hot exhaust gases that have passed through the inside of the exhaust pocket. The heating of the fuel-air mixture results in more complete combustion inside the combustion chamber and thus less wastage of fuel. Also, having to travel through a rotating intake chamber 86 and over at least one exhaust pocket 74*a*–74*d*, with these pockets being staggered circumferentially (at radial intervals determined by the number of engine cylinders serviced), the fuel-air mixture has to travel a tortuous path when it is drawn from the first intake port, through the intake chamber, and out the second intake port. The impugnment of the flow on these exhaust pockets 74*a*–74*d* and the directional changes required to flow over or around the exhaust pockets causes the fuel-air mixture to become more completely mixed or homogenized. This also results in more efficient combustion of the fuel-air mixture and less wastage of fuel.

Second Embodiment

Figure 13:
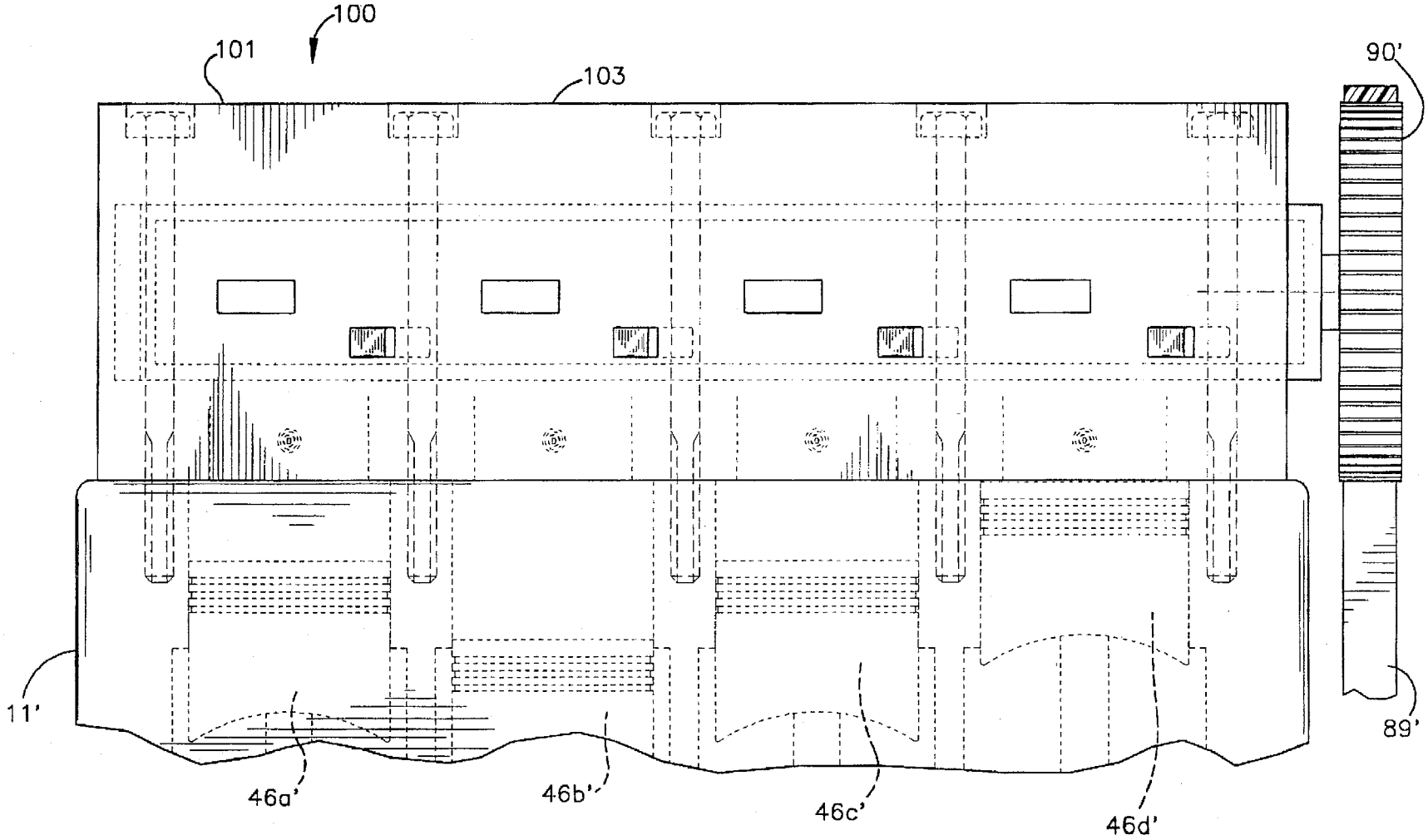
FIG. 13 is a side view of a second embodiment of the rotary valve system of the present invention shown mounted to a typical four cylinder internal combustion engine.
Figure 14:
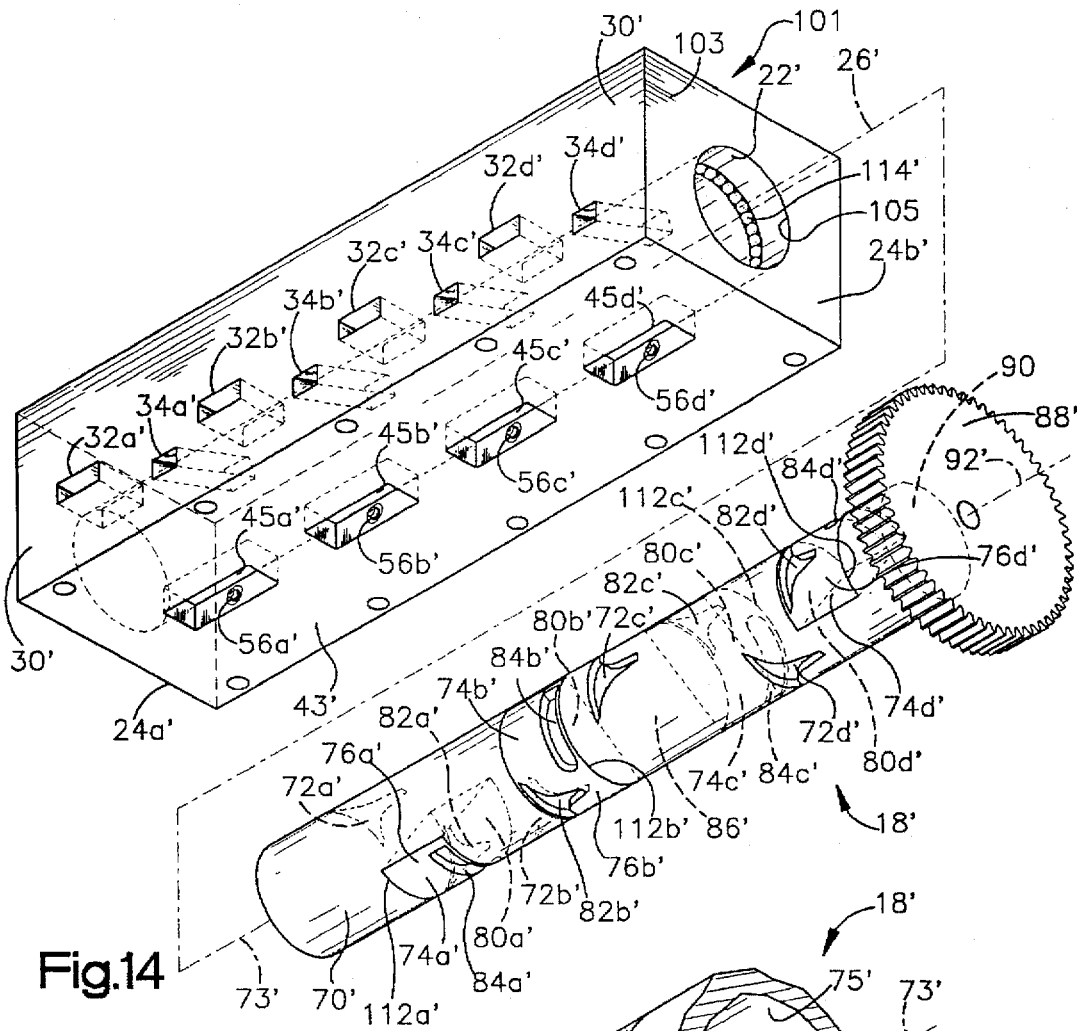
FIG. 14 is an exploded perspective view of the second embodiment of a rotary valve system according to the present invention in an embodiment for use with four engine cylinders.

Referring to FIG. 13, a perspective view of the a rotary valve system 100 is shown mounted to a typical four-stroke internal combustion engine, illustrated in the four cylinder embodiment. While the description of the preferred embodiment will be generally directed towards a four-stroke internal combustion engine, it is to be understood that rotary valve system 100 is equally applicable to a two-stroke engine or any other engine having intake and exhaust valves. Referring to FIG. 14, rotary valve system 100 consists primarily of an intake and exhaust manifold 101 and a rotary valve body 18'. Throughout the specification, primed numbers represent structural elements which are substantially identical to structural elements represented by the same unprimed number.

Referring to FIG. 14, intake and exhaust manifold 101 is comprised of a manifold block 103 with a cylindrical throughbore 105 extending along a longitudinal axis 26' from a first end wall 24*a*' to a second opposing end wall 24B'. Throughbore 22' is located in manifold block 103 so that longitudinal axis 26' is perpendicular to both end walls 24*a*' and 24*b*'. Extending through manifold block 103 are a plurality of fuel intake passages 32*a*', 32*b*', 32*c*', 32*d*' (32*a*'–32*d*') and an equal number of exhaust passages 34*a*', 34*b*', 34*c*', 34*d*' (34*a*'–34*d*'). Each intake passage 32*a*'–32*d*' extends through side wall 30' of manifold block 103, and through cylindrical wall 23' of throughbore 22'. Each exhaust passage 34*a*'–34*d*' extends through side wall 30' of manifold block 20' and through cylindrical wall 23' of throughbore 22'. A plurality of combustion cavities 45*a*', 45*b*40 , 45*c*', 45*d*' (45*a*'–45*d*') extend through the bottom wall 43' of manifold block 20' and through cylindrical wall 23' of throughbore 22' to piston bores 42*a*', 42*b*', 42*c*', 42*d*' (42*a*'–42*d*') located in an engine block 11' to form combustion chambers 44*a*', 44*b*', 44*c*', 44*d*' (44*a*'–44*d*') between pistons 46*a*', 46*b*', 46*c*', 46*d*' (46*a*'–46*d*') and combustion cavities 45*a*'–45*d*'. Combustion cavities 45*a*'–45*d*' are preferably rectangular in shape, although it is within the scope of the invention to make the combustion cavities any other shape, for example, a domed-cylinder or of a hemispherical shape. Each combustion chamber 45*a*'–45*d*' also has at least one sparking mechanism 56*a*', 56*b*', 56*c*', 56*d*' (56*a*'–56*d*'), such as a conventional spark plug, extending therein.

In the exploded illustration of the second embodiment of the present invention, as shown in FIG. 14, the manifold block 103 has four combustion cavities 45*a*'–45*d*', four fuel intake passages 32*a*'–32*d*', and four exhaust passages 34*a*'–34*d*'. This embodiment could be used to operate four cylinder engines or "V-eight" cylinder engines, the V-eight engines requiring two rotary valve systems 100 for each of the four cylinders which are in-line. However, it is within the scope of the invention to construct the manifold block with three combustion cavities, three fuel intake passages. Two of the latter rotary valve systems can be used to operate a "V-six" cylinder engine. Furthermore, it is within the scope of the invention to construct the manifold block of the disclosed rotary valve system with any number of combustion cavities and a corresponding number of fuel intake passages and exhaust passages, the number of which corresponds to the number of cylinder heads of the engine for which the rotary valve system is designed. In an alternative embodiment of the second embodiment of the present invention, there are three fuel intake passages, three exhaust passages, and three combustion cavities in manifold block 103 of intake and exhaust manifold 14', with two of such rotary valve systems being used to operate a "V-six" cylinder engine. Furthermore, it is within the scope of the invention to construct rotary valve cylinder 18' to have any number of intake ports and an equal number of exhaust pockets.

Figure 15:
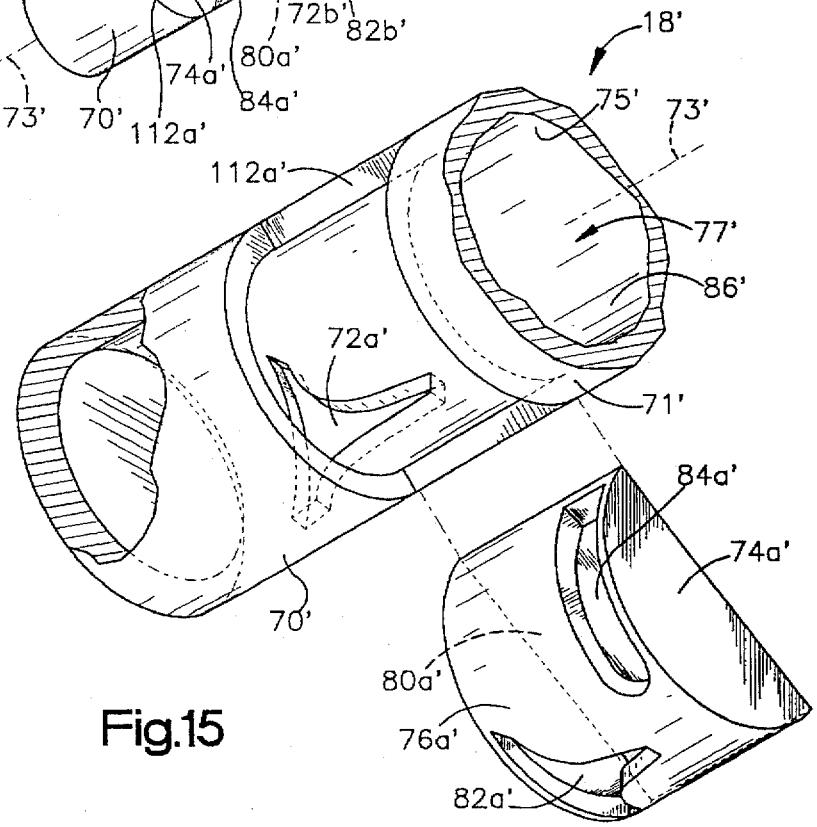
FIG. 15 is an exploded perspective view of a sections of a rotary valve body.

Referring to FIGS. 14 and 15, a rotary valve body 18' consists of a tubular valve cylinder 70' which typically has an axial length greater than the axial length of valve bore 22' and has an outside diameter slightly less than the inside diameter of valve bore 22'. As shown in FIG. 14, a plurality of valve fuel intake ports 72*a*', 72*b*', 72*c*', 72*d*' (72*a*'–72*d*') extend through the sidewall of valve cylinder 70' from outer valve wall 71' to inner valve wall 75'. The exact number of fuel intake ports 72*a*'–72*d*' corresponds to the number of combustion cavities 45*a*'–45*d*' and thus the number of engine cylinders. Although it is within the scope of the invention to construct fuel intake ports 72*a*'–72*d*' of any shape, in the preferred embodiment, each intake port 72*a*'–72*d*' is shaped somewhat like a bilateral triangle with the unequal side extending circumferentially, the triangle being truncated at the common angle of the equilateral sides, with the equilateral sides being curved inward (see FIG. 15). Referring to FIGS. 14 and 15, a plurality of exhaust pockets 74a', 74b', 74c', 74d' (74a'–74d') are each mounted in an opening 112a', 112b', 112c', 112d' (112a'–112d') of valve cylinder 70', by means such as welding, such that an outer curved wall 76a', 76b', 76c', 76d' (76a'–76d') of exhaust pockets 74a'–74d', respectively, blend with outer valve wall 71' of valve cylinder 70' and such that the remainder of exhaust pockets 74a'–74d' are located within the internal volume 77' enclosed by inner wall 75' of valve cylinder 70'. Each exhaust pocket 74a'–74d' encloses an exhaust chamber 80a', 80b', 80c', 80d' (80a'–80d') and has a valve exhaust inlet port 82a', 82b', 82c', 82d' (82a'–82d') and a valve exhaust outlet port 84a', 84b', 84c', 84d' (84a'–84d') extending through outer curved wall 76a'–76d' of exhaust pocket 74a'–74d'. The number of intake ports 72a'–72d' and exhaust pockets 74a'–74d', each having a valve exhaust inlet port 82a'–82d' and a valve exhaust outlet port 84a'–84d', respectively, corresponds to the number of combustion cavities 45a'–45d' and thus the number of engine cylinders. The relative location, about the circumference of the valve body 18', of the fuel intake ports 72a'–72d' depend on the number of piston cylinders which the valve system 100 is serving; i.e., for two cylinders, the fuel intake ports are 180° apart, for three cylinders, the fuel intake ports are 120° apart, and for four cylinders, the fuel intake ports are 90° apart. A fuel intake chamber 86' in rotary valve body 18' is defined by the internal volume 77' less the volume of space occupied by the exhaust pockets 74a'–74d'. A pulley 88' is attached to one end 90' of valve cylinder 70' such that the rotational axis 92' of pulley 88' is coaxial with axis 73' of valve cylinder 70'. Two standard bearings 114', such as roller bearings, are disposed in the cylindrical wall 23' of manifold 14' and are spaced from end walls 24a' and 24b', to support the ends of rotary valve body 18'.

In the preferred embodiment of the present invention discussed above, there are four fuel intake ports 72a'–72d' extending through tubular valve cylinder 70' and four exhaust pockets 74a'–74d' attached to tubular valve cylinder 70' of rotary valve body 18'. However, it is within the scope of the invention to construct rotary valve cylinder 18' to have any number of fuel intake ports and an equal number of exhaust pockets, the number of which corresponds to the number of combustion cavities 45a'–45d' in the intake and exhaust manifold 14'.

Rotary valve system 100 is constructed by assembling rotary valve body 18' into the throughbore 22' of manifold block 103 so that valve body axis 73' of rotary valve body 18' is coaxial with bore axis 26' of manifold block 103. The rotary valve system 100 is mounted to an engine 111 by placing the mounting face 43' of manifold block 20' onto the engine block above the cylinder heads so that the cylinder heads of the engine align with the combustion cavities 45a'–45d' of the manifold block 20'. A belt 89' is attached to pulley 88' of rotary valve body 18' to connect pulley 88' with a second pulley (not shown) on the crankshaft of the engine. A lubrication system (not shown) allows a standard lubricant to enter through the manifold block 103 and provides lubrication for the whole rotary valve system and, in particular, between outer surface 71' of tubular valve cylinder 70' and the cylindrical wall 23' of throughbore 22' of manifold block 103.

The operation of the rotary valve system 100 of the present invention is illustrated in FIGS. 16A–16D, for a four cylinder engine operating under the four-stroke process. However, it is within the scope of the present invention to use the disclosed rotary valve system to operate an internal combustion engine with any number of cylinders and/or operating under the two-stroke process.

Referring to FIG. 16A–16D, as the pistons cycle within their respective cylinders, rotary valve body 18' is continuously rotating by the operation of pulley 88', which is driven by the crankshaft of the engine. The rotation of valve body 18' is coordinated with the timing of the piston cycles, which preferably operates under the four stroke system so that the valve body rotates twice per every rotation of the engine crankshaft, i.e., a ratio of 2:1. The processes of in taking the fuel mixture, typically the fuel-air mixture, into the combustion chamber and evacuating exhaust gases from the combustion chamber 44a'–44d' are outlined below as two separate operations, but both processes occur simultaneously and continuously in different piston cylinders, as shown in FIGS. 16A–16D.

Figure 16A:
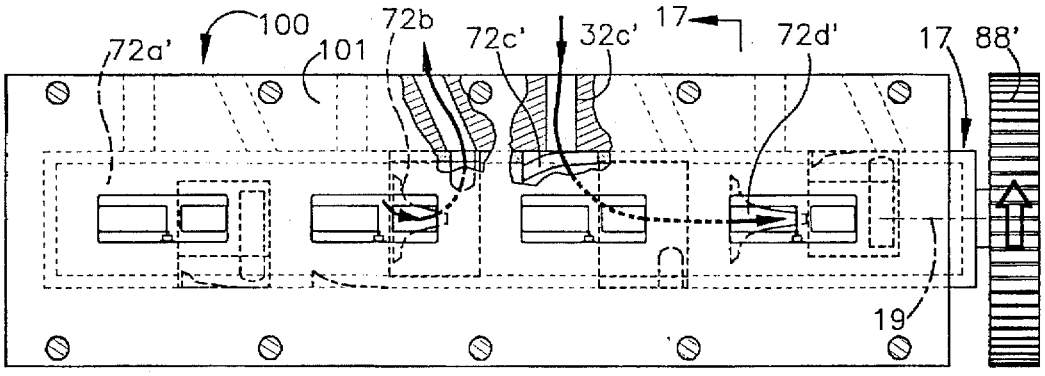
FIGS. 16A–16D are each a bottom view of the second embodiment of the rotary valve system, showing four different positions of the rotary valve system to illustrate its operation.
Figure 16B:
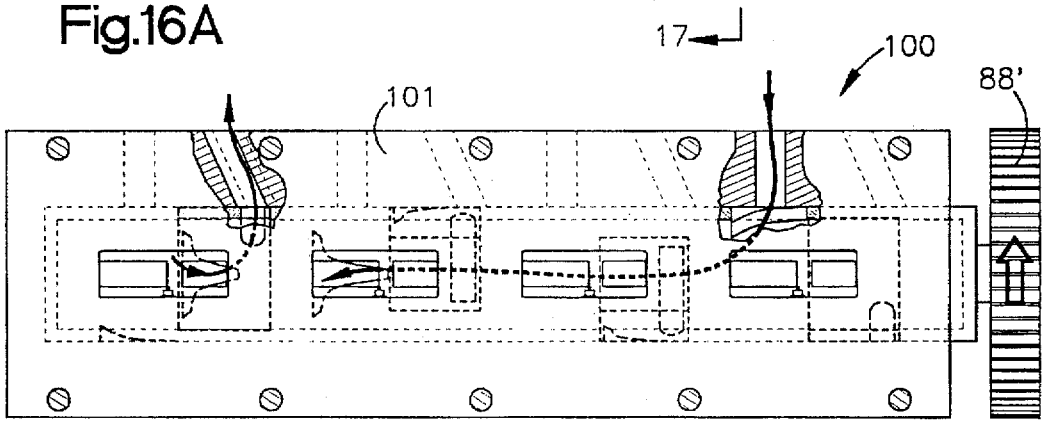
Figure 16C:
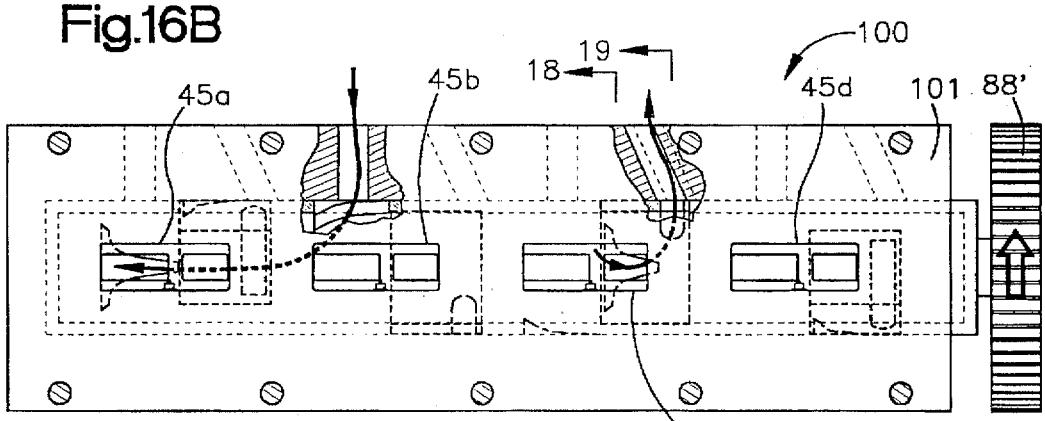
Figure 16D:
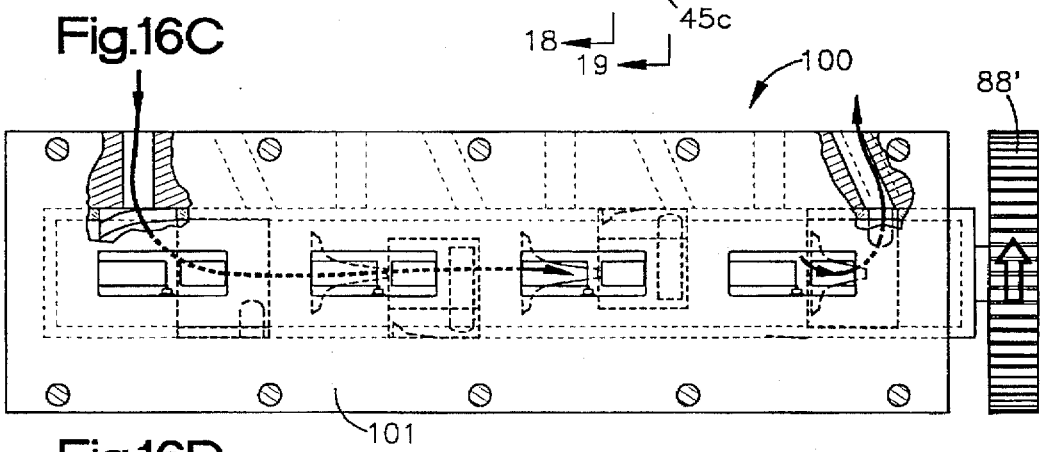
Figures 17, 18, 19:
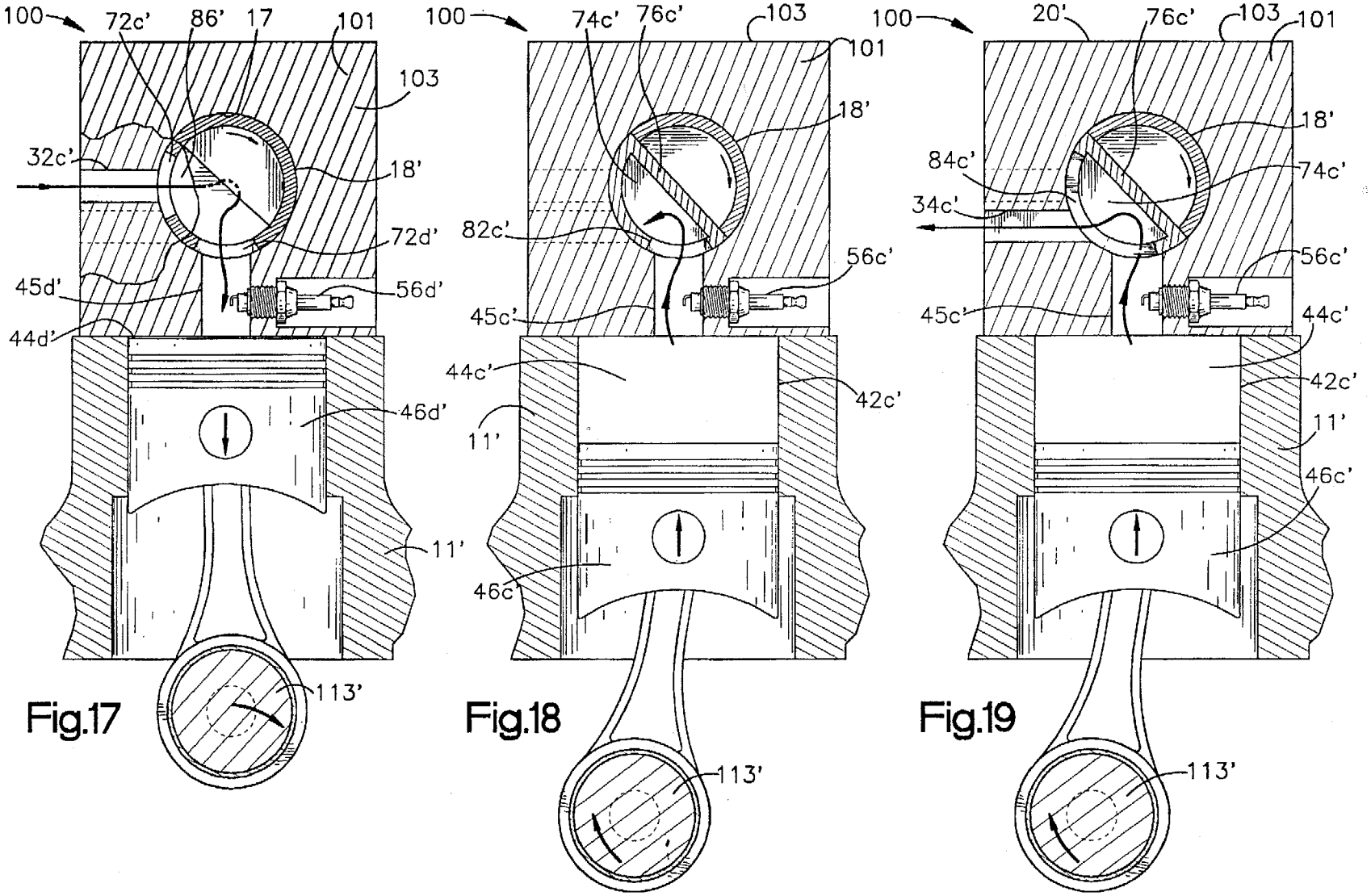
FIG. 17 is a cross-sectional view through line 17—17 of FIG. 16A illustrating the intake ports of the valve body in relation to the fuel inlet passage of the intake and exhaust manifold to illustrate the intake process of the valve system.
FIG. 18 is a view through line 18—18 of FIG. 16C illustrating the exhaust flowing from the combustion chamber to the exhaust pocket.
FIG. 19 is a view through line 19—19 of FIG. 16C illustrating the exhaust flowing from the exhaust pocket through the exhaust passage of the manifold.

Referring to FIGS. 16A and 17, the process of intaking the fuel-air mixture into the combustion chamber 44d' begins as follows: due to the relative location of the individual intake ports 72a'–72d' about the circumference of the valve body 18' and the coordination of the rotation of the valve body 18' with the timing of the engine operation, one valve intake port, e.g. 72c', will cross manifold intake passage 32c' when another intake port, e.g, intake port 72d', simultaneously crosses combustion cavity 45d', thus providing a fuel path to combustion chamber 44d'. At this time, the piston 46d' in the piston bore below the combustion cavity 45d' is moving downward for an intake stroke. The partial vacuum created by the downward travel of the piston 46d' in the piston bore draws the fuel-air mixture from the intake passage 32d' of manifold 14 to the combustion chamber 44d' directly above the piston 46d' by way of the path outlined below.

The flow of the fuel-air mixture proceeds along the following path during intake, as herein illustrated by a path between a first intake port 72c' and a second intake port 72d' (see FIG. 17). First, fuel-air mixture enters intake and exhaust manifold 101 through manifold intake passage 32c', then flows through valve intake port 72a' as the latter crosses the manifold intake passage 32c' and into the intake chamber 86' of rotary valve body 18'. Next, the fuel-air mixture flows from the intake chamber 86', through a second intake port 72d' as it crosses the associated combustion cavity 45d', through combustion cavity 45d', and into the associated combustion chamber 44d'. Rotation of valve body 18' causes valve wall 71' of the rotary valve body 18' to seal the combustion cavity 45d', thus causing combustion chamber 44d' to be an enclosed volume during the compression and power strokes of the piston 46d'.

Referring to FIGS. 18 and 19, the evacuation of exhaust gases from the combustion chamber 44c', for example, is accomplished by the following operation of the rotary valve system 100. The rotation of rotary valve body 18' is timed so that during the exhaust stroke of engine piston 46c', the valve exhaust inlet port 82c' of valve body 18' passes across the associated combustion cavity 45c' so that exhaust gasses flow out the combustion chamber 44c' through the combustion cavity 45c', through the valve exhaust inlet port 82c', and into the exhaust chamber 74c' of exhaust pocket 76c'. At the same time that the exhaust inlet port 82c' passes across combustion cavity 45c', and for a time after as the valve body 18' continues to rotate, the valve exhaust outlet port 84c' passes across the associated manifold exhaust outlet passage 34c', enabling the exhaust gases to flow from the exhaust chamber 74c', through valve exhaust outlet port 84c' and finally through the exhaust passage 34c' of the manifold block 20'.

The rotary valve system 100 can be constructed to accommodate any desired firing order in the engine cylinders by altering the arrangement of the fuel intake ports 72a'–72d' about the circumference of valve cylinder 70'. For example, in a four cylinder valve arrangement wherein four fuel intake ports 72a'–72d' are located about outer valve wall 71' at 90 degrees from each other about the circumference of the valve cylinder, one fuel intake port 72a'–72d' will be aligned with its respective manifold fuel intake passage 34a'–34d', respectively, allowing fuel-air mixture to flow into the intake chamber 86' at the same time that another intake port 72a'–72d' will be aligned with its corresponding combustion cavity 45a'–45d' to allow the fuel-air mixture to pass from the intake chamber and into the combustion chamber. Thus, the order of firing in the combustion chambers is dictated by the specific combination of fuel intake ports 72a'–72d', i.e., which intake port is aligned with its associated manifold fuel intake passage 34a'–34d' when another intake port is aligned with its associated combustion cavitiy 45a'–45d'. Therefore, the firing order for four cylinders could be one-two-three-four, one-three-two-four, one-four-two-three, one-two-four-three, one-three-four-two, or one-four-three-two, although the desired order will be limited by other considerations. The firing order illustrated in FIGS. 16A–16D is one-three-four-two.

Two important features of the second embodiment of the present invention, as with the first embodiment, result from the intake path of the fuel-air mixture. After entering the intake chamber 86' through a first intake port 72a'–72d', the fuel-air mixture has to travel across at least one exhaust pocket 74a'–74d' before it can exit the intake chamber through a second intake port 72a'–72d'. By traveling across at least one exhaust pocket 74a'–74d', and usually a plurality of such pockets, the fuel-air mixture absorbs heat convectively that has been conducted through the pocket walls from the hot exhaust gases that have passed through the inside of the exhaust pocket. The heating of the fuel-air mixture results in more complete combustion inside the combustion chamber and thus less wastage of fuel. Also, having to travel through a rotating intake chamber 86' and over at least one exhaust pocket 74a'–74d', with these pockets being staggered circumferentially (at radial intervals determined by the number of engine cylinders serviced), the fuel-air mixture has to travel a tortuous path when drawn it is from the first intake port 72a'–72d', through the intake chamber 86', and out the second intake port 72a'–72d'. The impignment of the flow on the exhaust pockets 72a'–72d' and the directional changes required to flow over or around the exhaust pockets causes the fuel-air mixture to become more completely mixed or homogenized. This also results in more efficient combustion of the fuel-air mixture and less wastage of fuel.

It is apparent that there has been provided in accordance with this invention a rotary valve apparatus for internal combustion engines. One embodiment of the invention comprises a rotary valve body mounted inside a valve sleeve, which is in turn mounted in an intake and exhaust manifold. The valve body is rotated by conventional means so that one of a plurality of fuel intake ports extending through the sidewall of the rotary valve body passes across a sleeve fuel intake port to allow flow communication between the manifold and the fuel intake chamber within the rotary valve body. At the same time, another fuel intake port passes across a sleeve outlet port to provide flow communication between the valve intake chamber and a combustion chamber of the engine, when the piston below the combustion chamber is moving downwards in an intake stroke. The fuel-air mixture is then dram by the downward action of the piston from manifold, through the fuel intake chamber of the rotary valve body, and into the combustion chamber. As the rotary valve continues to rotate, the outer wall of the valve body passes across the sleeve fuel outlet port that communicates with the combustion chamber, thus sealing the combustion chamber during the compression and power strokes. When the piston moves upward for the exhaust stroke, further rotation of the valve body causes an a valve exhaust inlet to pass across the sleeve exhaust inlet port, thus opening communication between combustion chamber and a chamber in an exhaust pocket disposed within the rotary valve body. At the same time, an outlet port from the exhaust chamber passes across a sleeve exhaust outlet port to open flow communication between the exhaust chamber and an exhaust passage in the intake and exhaust manifold. Exhaust gases are then evacuated from the combustion chamber, through the exhaust chamber and out of the exhaust passage of the manifold. The exhaust chambers are enclosed in exhaust pockets attached to the rotary valve body, these pockets being constructed and attached so that the exhaust gases are maintained separate from the fuel-air mixture passing through the intake chamber of the rotary valve body. The rotary valve system is designed and constructed to be capable of adjusting the axial and angular position of the valve sleeve relative to the rotary valve body, thus changing the size of, and/or the timing when, the rotary intake ports pass across valve sleeve openings, which allows adjustment of the amount of fuel-air mixture entering the combustion chambers of the engine and the timing of the intake of such mixture.

Furthermore, there is provided an alternative rotary valve system primarily comprising a rotary valve body mounted inside an intake and exhaust manifold. This embodiment operates in a manner similar to the first embodiment described above except that intake and exhaust gases do not flow through sleeve openings and there is no ability to adjust the amount of fuel-air mixture or the timing of the intake of such mixture.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A rotary valve system for use in an internal combustion engine, comprising:

an intake and exhaust manifold having a cylindrical throughbore extending between opposing endwalls of said manifold, at least two manifold fuel intake passages and at least two manifold exhaust passages extending through a sidewall of said manifold to said throughbore, and at least two combustion cavities extending through a bottom wall of said manifold to said throughbore;

a tubular valve sleeve disposed within said cylindrical throughbore of said manifold, said tubular valve sleeve having a tubular sidewall with at least two sleeve fuel intake ports each in flow communication with one of said at least two manifold fuel intake passages, at least two sleeve fuel outlet ports each in flow communication with one of said at least two combustion cavities, at least two sleeve exhaust inlet ports each in flow communication with one of said at least two combustion cavities, and at least two sleeve exhaust outlet ports each in flow communication with one of said at least two manifold exhaust passages, extending through said tubular sidewall; and a rotary valve body disposed within said tubular valve sleeve, said rotary valve body having a tubular valve cylinder forming a fuel intake chamber and having at least two rotary valve fuel intake ports adapted for flow communication with said at least two sleeve fuel intake ports and said at least two sleeve fuel outlet ports, at least two valve exhaust inlet ports adapted for flow communication with said at least two sleeve exhaust inlet ports, and at least two valve exhaust outlet ports adapted for flow communication with said at least two sleeve exhaust outlet ports, extending through a sidewall of said tubular valve cylinder.

2. The rotary valve system of claim 1 further including a pulley attached to a closed end of said rotary valve body and disposed outside of said manifold.

3. The rotary valve system of claim 1 including a cylindrical plate mounted to one end of said tubular valve sleeve for positioning said tubular valve sleeve within said cylindrical throughbore of said intake and exhaust manifold.

4. The rotary valve system of claim 3 including:

a first controller connected to said cylindrical plate for turning said valve sleeve about a longitudinal axis extending through said cylindrical throughbore of said intake and exhaust manifold; and a second controller motor connected to said cylindrical plate for moving said valve sleeve along said longitudinal axis extending through said cylindrical throughbore of said intake and exhaust manifold.

5. The rotary valve system of claim 4 including a computer connected to said first and second controllers.

6. The rotary valve system of claim 5 wherein:

said first controller is a first servomotor connected to said cylindrical plate by a gear mechanism to turn said valve sleeve; and said second controller is a second servomotor motor connected to said cylindrical plate by a lead screw to reciprocally move said valve sleeve.

7. The rotary valve system of claim 6 wherein said first and second servomotors operated by said computer.

8. The rotary valve system of claim 1 further including:

at least two exhaust pockets attached to said sidewall of said rotary valve body and substantially disposed within said fuel intake chamber enclosed by said sidewall, each of said at least two exhaust pockets forming an exhaust chamber, defined as the internal volume of said enclosed pocket, and having one of said rotary valve exhaust inlet ports and one of said rotary valve exhaust outlet ports.

9. The rotary valve system of claim 8 wherein:

said intake and exhaust manifold has four of said manifold fuel intake passages, four of said manifold exhaust passages and four of said combustion cavities;

said tubular valve sleeve has four of said sleeve fuel intake ports, four of said sleeve fuel outlet ports, four of said sleeve exhaust inlet ports, and four of said sleeve exhaust outlet ports; and said rotary valve body has four of said rotary valve fuel intake ports and four of said exhaust pockets.

10. The rotary valve system of claim 1 wherein:

each of said rotary valve fuel intake ports has a first edge extending partially about the circumference of said tubular valve cylinder, a second edge longer than said first edge extending partially about the circumference of said tubular valve cylinder, and two equilateral edges which curve inward toward each other and connect with the ends of said first and second edges.

* * * * *